US006648752B2

(12) United States Patent
Vernier, II et al.

(10) Patent No.: US 6,648,752 B2
(45) Date of Patent: Nov. 18, 2003

(54) AIR DIFFUSER

(75) Inventors: Larry D. Vernier, II, New Port Richey, FL (US); Philippe Bernard Jean, Palm Harbor, FL (US)

(73) Assignee: Metal Industries, Inc., Clearwater, FL (US)

( * ) Notice: Subject to any disclaimer, the term of this patent is extended or adjusted under 35 U.S.C. 154(b) by 0 days.

(21) Appl. No.: 10/087,818

(22) Filed: Mar. 5, 2002

(65) Prior Publication Data

US 2002/0151269 A1 Oct. 17, 2002

Related U.S. Application Data

(63) Continuation of application No. 09/550,216, filed on Apr. 17, 2000, now Pat. No. 6,386,970.

(51) Int. Cl.[7] ..... F24F 13/072
(52) U.S. Cl. ..... 454/304; 454/301
(58) Field of Search ..... 454/301, 303, 454/304

(56) References Cited

U.S. PATENT DOCUMENTS

| | | | | |
|---|---|---|---|---|
| 2,239,508 | A | * 4/1941 | Sipp et al. | 454/296 |
| 2,671,395 | A | 3/1954 | Demuth | |
| 2,727,272 | A | 12/1955 | Hankin et al. | |
| 2,736,255 | A | 2/1956 | Tutt et al. | |
| 2,821,897 | A | 2/1958 | Kreuttner | |
| 2,859,681 | A | 11/1958 | Rachlin | |
| 2,992,743 | A | 7/1961 | Wing | |
| 3,067,669 | A | 12/1962 | O'Day et al. | |
| 3,072,038 | A | 1/1963 | Phillips | |
| 3,082,676 | A | 3/1963 | Church et al. | |
| 3,093,058 | A | 6/1963 | La Vigne et al. | |
| 3,099,949 | A | 8/1963 | Davidson | |
| 3,101,661 | A | 8/1963 | Bibb | |
| 3,103,869 | A | 9/1963 | Dry | |
| 3,126,811 | A | 3/1964 | Kennedy | |
| 3,127,827 | A | 4/1964 | Ericson | |
| 3,132,579 | A | 5/1964 | La Vigne et al. | |
| 3,183,821 | A | 5/1965 | Averill et al. | |
| 3,185,068 | A | 5/1965 | Straub et al. | |
| 3,185,069 | A | 5/1965 | Straub et al. | |
| 3,187,661 | A | 6/1965 | Dail | |
| 3,202,077 | A | 8/1965 | Lee | |
| 3,204,547 | A | 9/1965 | Ericson | |
| 3,207,057 | A | 9/1965 | Brown et al. | |
| 3,220,332 | A | 11/1965 | Straub | |
| 3,223,019 | A | 12/1965 | Schuh | |
| 3,227,063 | A | 1/1966 | Lambert | |
| 3,242,847 | A | 3/1966 | Averill et al. | |
| 3,250,205 | A | 5/1966 | Lambert | |
| 3,260,188 | A | 7/1966 | Person | |
| 3,274,916 | A | 9/1966 | Waeldiner et al. | |
| 3,276,348 | A | 10/1966 | Kennedy | |
| 3,276,349 | A | 10/1966 | Person | |
| 3,295,432 | A | 1/1967 | Palmquist | |
| 3,302,550 | A | 2/1967 | Thomson | |

(List continued on next page.)

FOREIGN PATENT DOCUMENTS

| | | |
|---|---|---|
| CA | 1194666 | 10/1985 |
| CA | 1213118 | 10/1986 |
| CA | 1215514 | 12/1986 |

(List continued on next page.)

*Primary Examiner*—Harold Joyce
(74) *Attorney, Agent, or Firm*—Frijouf, Rust & Pyle, P.A.

(57) ABSTRACT

An air diffuser for an air distribution system is disclosed comprising a first and a second border member. Plural spreaders interconnect the first and second border members thereby defining an airflow aperture therebetween. A pattern controller is slidably disposed between the plural spreaders for controlling the volume of airflow through the airflow aperture. The pattern controller is pivotable within the airflow aperture for controlling the direction of airflow through the airflow aperture.

8 Claims, 15 Drawing Sheets

U.S. PATENT DOCUMENTS

| | | | | |
|---|---|---|---|---|
| 3,308,743 | A | | 3/1967 | Waekiner et al. |
| 3,308,744 | A | | 3/1967 | Schach |
| 3,308,745 | A | | 3/1967 | Davies |
| 3,320,869 | A | | 5/1967 | Schach |
| 3,327,608 | A | | 6/1967 | Newell et al. |
| 3,353,473 | A | | 11/1967 | Oneson et al. |
| 3,361,050 | A | | 1/1968 | Segil et al. |
| 3,364,839 | A | | 1/1968 | Sweeney et al. |
| 3,366,029 | A | | 1/1968 | Reynders |
| 3,383,999 | A | | 5/1968 | Fragnito et al. |
| 3,387,550 | A | | 6/1968 | Thomson |
| 3,390,624 | A | | 7/1968 | Averill |
| 3,401,622 | A | | 9/1968 | Honerkamp |
| 3,406,623 | A | | 10/1968 | Lambert |
| 3,411,425 | A | | 11/1968 | Lambert |
| 3,411,428 | A | | 11/1968 | Ahlrich |
| 3,412,669 | A | | 11/1968 | Averill |
| 3,440,947 | A | | 4/1969 | Averill |
| 3,444,801 | A | | 5/1969 | Lambert |
| 3,511,163 | A | | 5/1970 | Newell et al. |
| 3,584,565 | A | | 6/1971 | Bush et al. |
| 3,590,719 | A | | 7/1971 | Lambert et al. |
| 3,601,033 | A | | 8/1971 | Lambert |
| 3,665,837 | A | | 5/1972 | Balfanz, Jr. |
| 3,673,946 | A | | 7/1972 | Ragland |
| 3,690,243 | A | | 9/1972 | Lambert |
| 3,699,872 | A | | 10/1972 | Kruger |
| 3,703,140 | A | | 11/1972 | Gutheim |
| 3,733,995 | A | | 5/1973 | Brown |
| 3,748,998 | A | | 7/1973 | Lambert |
| 3,757,667 | A | | 9/1973 | Lambert |
| 3,760,709 | A | | 9/1973 | Rachlin et al. |
| 3,796,367 | A | | 3/1974 | Rifkin |
| 3,811,369 | A | | 5/1974 | Ruegg |
| 3,828,508 | A | | 8/1974 | Moeller |
| 3,831,506 | A | | 8/1974 | Lanheer |
| 3,837,267 | A | | 9/1974 | Lambert |
| 3,848,799 | A | | 11/1974 | Day |
| 3,855,909 | A | | 12/1974 | Lambert |
| 3,918,354 | A | | 11/1975 | Lambert |
| 3,919,928 | A | | 11/1975 | Lambert |
| 3,967,780 | A | | 7/1976 | Traver |
| 4,008,653 | A | | 2/1977 | Tatham |
| 4,018,160 | A | | 4/1977 | Cunningham et al. |
| 4,019,566 | A | | 4/1977 | Cobb |
| 4,077,310 | A | | 3/1978 | McCabe, Jr. et al. |
| 4,130,975 | A | | 12/1978 | Kelley |
| 4,163,416 | A | | 8/1979 | Kurrle et al. |
| 4,258,616 | A | | 3/1981 | Zeller et al. |
| 4,316,407 | A | | 2/1982 | Lambert |
| 4,426,918 | A | | 1/1984 | Lambert |
| 4,449,166 | A | | 5/1984 | Sharp |
| 4,475,446 | A | | 10/1984 | McCall |
| 4,491,062 | A | | 1/1985 | Sylvester et al. |
| 4,515,069 | A | | 5/1985 | Kline et al. |
| 4,535,932 | A | | 8/1985 | Herb |
| 4,625,629 | A | | 12/1986 | Bryans |
| 4,672,887 | A | * | 6/1987 | Sproul, Sr. |
| 4,844,283 | A | | 7/1989 | Justus |
| 4,851,066 | A | | 7/1989 | Currier et al. |
| 4,869,157 | A | | 9/1989 | Hungerford |
| 4,979,433 | A | | 12/1990 | Muller et al. |
| 5,001,967 | A | | 3/1991 | Hungerford |
| 5,046,405 | A | | 9/1991 | Roy |
| 5,088,388 | A | | 2/1992 | Schaefer |
| 5,103,869 | A | | 4/1992 | Kimura et al. |
| 5,107,687 | A | | 4/1992 | Candeloro |
| 5,107,755 | A | | 4/1992 | Leban et al. |
| 5,156,569 | A | | 10/1992 | Muller et al. |
| 5,194,042 | A | | 3/1993 | Clark |
| 5,215,284 | A | | 6/1993 | Hungerford |
| 5,261,857 | A | | 11/1993 | Petterson et al. |
| 5,297,326 | A | | 3/1994 | Kline |
| 5,433,662 | A | | 7/1995 | Hungerford |
| 5,447,471 | A | | 9/1995 | McDermott |
| 5,569,078 | A | | 10/1996 | Kirkpatrick |
| 5,577,958 | A | | 11/1996 | Kumekawa et al. |
| 5,667,437 | A | | 9/1997 | Donnelly |
| 5,788,572 | A | | 8/1998 | Felsen |
| 6,431,247 | B1 | * | 8/2002 | Harrison et al. ..... 160/168.1 R |
| 2002/0094773 | A1 | * | 7/2002 | Howard et al. ..... 454/306 |

FOREIGN PATENT DOCUMENTS

| | | | | |
|---|---|---|---|---|
| CA | 2110954 | | 6/1995 | |
| CA | 2083787 | | 10/1995 | |
| CA | 2119285 | | 11/1997 | |
| CA | 2071680 | | 5/1998 | |
| DE | 843290 | | 7/1952 | |
| DE | 2256126 | | 8/1973 | |
| DE | 1470139 | | 4/1975 | |
| DE | 2518609 | | 4/1975 | |
| EP | 142834 | | 11/1984 | |
| FR | 2308873 | | 11/1976 | |
| GB | 1361077 | | 7/1974 | |
| GB | 2195758 | | 4/1988 | |
| SE | 181573 | * | 11/1962 | ..... 454/301 |

* cited by examiner

AIR DIFFUSER

This application is a continuation of application Ser. No. 09/550,216 filed Apr. 17, 2000 U.S. Pat. No. 6,386,970. All subject matter set forth in application Ser. No. 09/550,216 is incorporated by reference into the present application as if fully set forth herein.

BACKGROUND OF THE INVENTION

1. Field of the Invention

This invention relates to air distribution systems and more particularly to the improved air diffuser for an air distribution system such as an air conditioning and heating system.

2. Prior Art Statement

Various types of air diffusers have been used by the prior art in air distribution systems. Typically, an air diffuser transforms airflow from an airflow conduit into an airflow in an expanded space such as a room or the like. The air diffuser transforms the high-pressure, high airflow rate within the airflow conduit into low pressure, low flow rate airflow within the expanded space. The air diffuser was required to accomplish this distribution without excessive noise, and With the ability to vary the direction of airflow emanating from the air diffuser. In many cases, the air diffusers were required to have an aesthetically pleasing appearance.

Typically, the air diffusers of the prior art appeared in the form of a substantially square or rectangular grille. In some instances, the grille was variable to vary the direction of airflow emanating from the grille.

In recent years, a new type of air diffuser has been introduced into the air distribution field. This new type of air diffuser is commonly referred to as a linear air diffuser. The linear air diffuser appeared in the form of a narrow opening extending along a linear or curved line in a wall or a ceiling. In many cases, the linear air diffuser was preferred over the substantially square or rectangular grilles of the prior art due to the more aesthetic appearance of the linear air diffuser. The following United States Patents are representative of linear air diffusers of the recent prior art.

U.S. Pat. No. 2,727,272 to Hankin et al. discloses a curtain suspension device, a glider comprising an upright body portion of rectangular cross section merging at its upper end into a transverse cylindrical portion, by which the glider as a whole may be freely suspended, and merging at its lower end into an arcuate portion lying in the same plane as said body portion, said body portion also having a transversely projecting configuration in the shape of an inverted V which bridges the arcuate portion of the glider.

U.S. Pat. No. 2,992,743 to Wing discloses a support for display fixtures and the like, in combination, a hollow upright adapted to detachably receive an article to be supported, a horizontally disposed leveling frieze mountable on a wall, means on said upright and slidably engaging said frieze for suspending said upright in spaced relation to said wall for sliding movement therealong, said upright comprising a straight upper body having a lower part inclined downwards in a direction away from said wall, said inclined part terminating in a vertical leg, a foot adjustable vertically in said leg into ground engagement, and adjustable means carried by the body of said upright movable into engagement with the wall to hold said upright vertical.

U.S. Pat. No. 3,127,827 to Ericson discloses a ventilated ceiling construction comprising a plurality of ceiling panels arranged in side-by-side relation, and a plurality of rails supporting said panels; each rail including an elongated rib disposed in spaced relation with respect to the marginal portion of an adjacent panel, a flange extending transversely from said rib, said flange having an outer portion engaging and supporting the marginal portion of said adjacent panel and an inner portion spaced from said panel marginal portion and provided with a plurality of ventilating openings, and valve means carried by said rail and slidably mounted on said flange inner portion to effect opening and closing of said ventilating openings.

U.S. Pat. No. 3,202,077 to Lee discloses a sub-ceiling support grid work having inverted T bar elements, diffuser elements of air distribution duct assemblies and hangers for suspending said grid work at a certain level below the main ceiling of a room and in which said T bar elements and air distribution diffuser elements have oppositely directed horizontal flanges all lying at the same level for supporting sub-ceiling elements, an expansion channel for cooperation with said grid work elements comprising, in combination a pair of laterally spaced, vertically extending elongated side members an outwardly directed flange on the lower portion of each side member, an elongated bifurcated member having downwardly extending spaced arms and a top center web, means on said web for suspending said bifurcated member from the main ceiling and cooperating engageable means on said side members and the lower parts of said arms for supporting said side members.

U.S. Pat. No. 3,207,057 to Brown et al. discloses a grid for supporting a plurality of individual panel members in a plane including a plurality of structural beams disposed in intersecting relation to each other in a predetermined geometric configuration, each of said beams having a web portion defining a pair of spaced parallel marginal edges, a beam bead portion along one of said marginal edges and a flange portion extending laterally of said web along the other marginal edge, a plurality of panel supporting clips disposed at spaced intervals along each of said beams, said clips being of generally U-shape and adapted to be suspended over said beam bead portions, the legs of said clip terminating in outwardly projecting flanges adapted to engage the marginal edges of panels to be supported thereby adjacent said web portion and in spaced relation to said beam flange portion.

U.S. Pat. No. 3,276,348 to Kennedy discloses an air distributor having, in combination, first and second elongated walls disposed in laterally spaced side-by-side relation and cooperating to define a passage of elongated cross-section for the flow of air in one direction between said walls, first and second elongated deflecting flanges extending along the downstream edges of said first and second walls, respectively, and projecting across said passage in a common plane to define between their opposed edges an elongated outlet slot for said passage, a plurality of bars spaced apart longitudinally of said passage in a second plane spaced inwardly from and paralleling the plane of said flanges, each of said bars being secured at its opposite ends to said walls to join the latter rigidly together, an elongated deflector vane substantially narrower than said passage disposed in and extending longitudinally of the passage along corresponding sides of said bars with on side of said vane facing upstream, said vane being supported on said bars for back and forth edgewise movement relative to the bars between a first deflecting position in which one longitudinal edge of the vane is closely adjacent said first wall and the other edge is spaced from said second wall to define a slot-like opening in said passage aligned with said second flange, and a second deflecting position closely adjacent said second wall to define a slot-like opening in said passage aligned with said first flange whereby said vane and one of said deflecting flanges cooperated to deflect airflowing through said passage first laterally and along one of said walls and then out through said outlet slot along an inclined path, and means for holding said vane releasably in each elected position relative to said bars.

U.S. Pat. No. 3,302,550to Thomson discloses an air distributor having in combination, parallel walls laterally spaced apart and defining the sides of an elongated passage adapted for the flow of air through said passage, each of said parallel walls having an inwardly directed wall the inner edges of which are spaced apart to form a slot for the passage of air therethrough, an intermediate wall held in spaced relationship to said parallel walls and terminating above said inwardly directed walls, said intermediate wall forming a support for a pair of individually, vertically slidable vane members, and means for supporting said vane members in vertically adjusted positions, said vane members adapted to bear against said inwardly directed walls when in fully lowered position to prevent flow of air through said slot.

U.S. Pat. No. 3,308,744 to Schach discloses an air distributor having, in combination, laterally spaced and substantially parallel sidewalls defining the sides of an air passage having an elongated outlet end, flanges extending inwardly from said wall at said outlet end substantially in a common plane and perpendicular to the walls with the adjacent edges of said flanges spaced apart to define an elongated air discharge slot generally centered in said outlet end, a pintle disposed within said passage generally parallel to said slot and overlying the latter midway between said walls, supports spaced apart along said passage longitudinally of said slot and secured to said walls with the opposite ends of said pintle mounted on said supports, two elongated vanes each having a longitudinal edge extending along said pintle and ends close to the respective supports, and means hingedly connecting each of said longitudinal edges to said pintle, said vanes being swingable about the pintle from blocking positions substantially closing said passage into side-by-side positions extending downstream from the pintle toward said slot, and being swingable both together and independently about said pintle into different selected angular positions to vary the angle of discharge of air through said slot.

U.S. Pat. No. 3,411,425 to Lambert discloses a diffuser outlet for use in suspended ceiling installations including a pair of parallel, spaced ceiling elements, each including an upstanding leg and a bottom flange with the bottom flanges extending toward each other to define a diffuser outlet, means interconnecting the pair of ceiling elements in a predetermined spaced relation with the aforementioned flanges spaced from each other and in the ceiling plane to form the diffuser outlet in the plane of the ceiling, a weir member between the legs of said ceiling elements and means for mounting the weir member in a plane virtually parallel to the ceiling plane, but spaced above the flanges, for lateral movement in said plane to vary the direction of flow of air through the outlet.

U.S. Pat. No. 3,444,801 to Lambert discloses a pair of suspended ceiling air diffuser T-bar elements assembled in spaced relation by pairs of oppositely opening channel-like spacer members with edge flanges received in opposed grooves formed adjacent inner wall surfaces of the T-bar members with resilient pad means positioned between the spacer member web portions for normally resiliently holding the spacer members in operative spaced relation assembled to and engaged with the recesses of the ceiling elements and being deformable during assembly or disassembly of the spacer member to the ceiling elements to facilitate assembly or disassembly of the apparatus. A weir member is positioned on the spacer members with end portions thereof in frictional engagement with the resilient pad means positioned at either end thereof on associated spacer means to yieldably retain the weir means in selectable positions of adjustment between the ceiling diffuser T-bars.

U.S. Pat. No. 3,601,033 to Lambert discloses a suspended-ceiling integrated air distribution system air diffuser assembly of spaced inverted T-bar support members has a blank-off channel mounted therein for blanking off a portion of the assembly from a continuous outlet of an air plenum chamber, and a series of openings through the members at the portion of the assembly for venting air from a room into an attic space above the ceiling and outside the plenum chamber. The openings are initially closed by removable knock-out plates and the openings may be selectively closed after once being opened by plates removably mounted to the members to selectively change the flow of air in the room.

U.S. Pat. No. 3,760,709 to Rachlin et al. discloses a supporting grid (e.g., main and cross inverted tees) of a suspended ceiling also supports ventilation air-distributing apparatus including an airflow spreader. This apparatus comprises a lower airflow channel section formed of two extruded metal bars having vertical webs with hooks on the outside of the web defining ways into which the wings of a bracket project to hold the spaced bars in a channel assembly. A clip integral with the bracket hooks over the top of a grid tee and has gripper conformations to mate with a clip on the opposite side of the tee to align channels. The air from the duct discharges out through the opening between the webs and a spreader directs the air generally outwardly, as well as downwardly. In one aspect of the invention, special brackets are provided to support the airflow spreader at its proper position.

U.S. Pat. No. 3,828,508 to Moeller discloses an improvement in a suspended ceiling tile construction wherein a permanent ceiling tile is affixed to a suspended bracket, which bracket extends toward an adjacent removable ceiling tile which improvement comprises a supporting member to join said removable tile to said bracket, a generally vertical member descending from said supporting member away from the vertical edge of said removable ceiling tile adjacent said permanent ceiling tile and rotatable means in the form of an eccentric button at the lower end thereof rotatable to dispose an eccentric portion of said button beneath said removable tile to support the same rotatable to remove said eccentric portion from beneath said ceiling tile so that the same is unsupported, the non-eccentric portion thereof disposed beneath said permanent tile; a button for securing a removable tile to a permanent ceiling tile which comprises a clip adapted to engage a structural member, a generally vertical member disposed beneath said clip remote from the exterior edge portion of said clip which engages said structural member and eccentric rotatably mounted to said vertical member.

U.S. Pat. No. 3,855,909 to Lambert discloses a linear air diffuser mounted in a suspended kerfed ceiling by coping the opposite ends of the diffusers to provide upwardly directed horizontal surfaces which are positioned beneath the flanges of adjacent pairs of the T-bars which are part of the ceiling support structure. Holding brackets have a sliding connection in the air diffusers and slide over the flange of ceiling T-bars between which the diffusers are positioned. Engagement between the holding brackets and the T-bar flanges supports the diffusers in the ceiling in a manner compatible with the monolithic appearance of the kerfed ceiling.

U.S. Pat. No. 3,919,928 to Lambert discloses a linear air plenum formed of duct board (generally a thickness of fiber glass) carries a linear diffuser. The air plenum-diffuser assembly is used with a ceiling having a series of main and cross-runner T-bars, or similar ceiling support members. With the diffuser carried by the linear plenum, a slot is provided in the ceiling by an air track; alternatively the slot may be defined by an air bar, which includes the diffuser elements in which case the air plenum is provided with an air outlet collar which registers with the air bar. A number of these assemblies are connected end-to-end and arranged parallel to one of the cross or main runners and at right angles to the others. The lengths of the air plenum and the attached diffuser, or air outlet collar, are related to the module upon which the ceiling is designed and the diffuser, or outlet collar, length is less than the overall length of the air plenum. The areas of the air his plenums between adjacent diffusers, or air outlet collars, are closed and spaced above the runners to be capable of functioning as air return areas.

U.S. Pat. No. 4,130,975 to Kelley discloses an improved insulation panel, which includes first and second extruded elongated aluminum plates, one of which contains a channel and the other a projection, by means of which they are placed in abutting engagement to form a single panel with a tongue formed on the end of one of said plates and a groove on the other of said plates, to permit placing a plurality of panels in abutting relationship without gaps therebetween, and in which, on the outside edges of each of said plates, and thus on the outside edges of said panel, there are formed C shaped channels, one of said channels, having installed therein, a plurality of mounting clips, and the other, having installed therein, a plurality of insulation retaining clips, both of said pluralities of clips being slideable in said channels, to facilitate the installation of said panels, with insulation retained behind the panels, against a structure such as a duct, precipitator or boiler requiring insulation.

U.S. Pat. No. 4,258,616 to Zeller et al. discloses an air outlet for the admission of conditioned air to rooms and other inhabited spaces includes an air box with an air outlet slot. The air outlet slot is longitudinally subdivided to form individual ducts each of which contains an independently adjustable air guide vane. Internally, the outlet slot may be variably obturated by three superimposed control slides, each of which has periodically occurring covering surfaces, the width of which corresponds to the width of an air outlet duct. The covering surfaces on each control slide are disposed at a distance corresponding to four duct widths. The air box contains thermostatically controlled actuators which are coupled to the control slides in such a way as to permit their relative longitudinal, i.e., axial, displacement when a first control slide is moved between positions corresponding, respectively, the second and/or third control slides are partially carried along so as to define configurations resulting in a variation of the volumetric airflow but maintaining the speed of the emerging air constant.

U.S. Pat. No. 4,316,407 to Lambert discloses a jet pair weir gate providing an air diffuser outlet and includes two pairs of nested jet weir members, each member having a generally U-shape channel configuration consisting of an imperforate web portion and two flange portions. Each pair of members in both laterally expansible and laterally moveable across the outlet width to cooperate with each other in providing selectable airflow patterns through the outlet. In a preferred embodiment, the medial flange of each pair of jet weir members is provided with an extended length serving as a control surface, each adjacent flanges together acting as an air nozzle to focus a jet flow of air therebetween.

U.S. Pat. No. 4,475,446 to McCall discloses an air diffuser for directing air through an elongated opening in a drop ceiling in a pattern directed along the plane of the ceiling comprises a plenum chamber from which air is directed through a pair of spaced parallel walls forming a duct communicating with the elongated opening. The opening is narrower than the space between the walls so as to form a ledge adjacent the inside of at least one of the walls. A first baffle positioned in the plenum chamber and projecting into the space between the walls forms a throat through which air is directed downwardly against the ledge, the ledge diverting the air out through the opening in a substantially horizontal throat toward the opposite wall and ledge where the air is redirected out the opening in the same horizontal pattern.

U.S. Pat. No. 4,491,062 to Sylvester et al. discloses an air diffuser including first and second walls disposed in spaced side-by-side relationship and cooperating to define a passage for the flow of air in one direction between said walls. A pair of flanges extend towards each other from the downstream edges of the walls and defining an elongated outlet slot narrower than the width of said passage and is disposed in the passage in a plane spaced upstream from the slot and generally parallel to said flanges. The deflector vane includes an inverted U-shaped central channel and flanges extending away from each other from the down stream ends of the U-shaped channel and arranged generally parallel to the flanges defining the slot. The opposite ends of the vane are engaged in a U-shaped support with a spring engaging one wall of the U-shaped support and biasing the vane flanges into sliding engagement with the other wall. The vane thus being supported for back and forth edgewise movement in the plane to a first position in which the vane is closely adjacent to the first wall and spaced from the second wall, a second position in which the vane is closely adjacent the second wall, or selective positions between the two extremes.

U.S. Pat. No. 4,515,069 to Kline et al. discloses a thermally powered change-over diffuser which includes a housing having an outlet and movable blade assembly mounted with respect to the outlet for displacement between a first position producing a Coanda flow across a surface, such as a ceiling, and a second position producing a detached stream in a generally normally extending direction with respect to the surface. The diffuser is preferably thermally powered and includes a rapid change-over assembly enabling substantially immediate shifting between the two positions so as to provide a cooling mode of discharge and heating mode of discharge. Additionally, means for adjusting the volume of air discharged is provided.

U.S. Pat. No. 4,535,932 to Herb discloses a diffuser providing three discharges. Two of the discharges are directed in one direction and, when installed, would be directed towards the outside wall of the conditioned space. The other discharge is directed in the opposite direction and would discharge into the interior of the conditioned space. Responsive to the temperature of the conditioned air being supplied,$_1$/a thermally responsive actuator is in either one of two positions whereby either one of the two discharges in the one direction or the discharge in the opposite direction is blocked. This results in two discharges in one direction or one in each direction with the discharge area being the same in both instances.

U.S. Pat. No. 4,625,629 to Bryans discloses a diffuser providing three discharges. Two of the discharges are direct in one direction and, when installed, would be directed towards the outside wall of the conditioned space. The other discharge is directed in the opposite direction and would discharge into the interior of the conditioned space. Responsive to the temperature of the conditioned air being supplied, either one of the two discharges in the one direction or the discharge in the opposite direction is blocked. This results in two discharges in one direction or one in each direction with the discharge area being the same in both instances.

U.S. Pat. No. 4,844,283 to Justus discloses a closure mechanism (15) including a pair of doors (25) biased in a closing direction and a cam (75) which symmetrically adjusts the position of the doors when drawn therethrough and asymmetrically adjusts the position of the doors when pivoted thereagainst.

U.S. Pat. No. 4,851,066 to Currier et al. discloses a bellow assembly providing a retainer member formed as an aluminum extrusion with tho uniformly spaced recesses formed therein. A bellows is provided with two uniformly spaced attachment members which coact with the spaced recesses to provide a uniform bellows profile for its entire length. Accordion pleat members are provided to attach the ends of the bellow to the ends of the retainer member.

U.S. Pat. No. 4,979,433 to Muller et al. discloses a swirl outlet with an outlet plate and blowout openings provided therein for warn and/or cold air, an air jet guiding slat (10) to be regulated individually is assigned to each outlet opening (5).

U.S. Pat. No. 5,001,967 to Hungerford discloses a modular air bar for mounting in the ceiling system of a structure, which modular air bar is characterized by a pivoting air controlling section sandwiched between a pair of spaced sliding controller modules, each of the latter having a pair of spaced air deflectors provided with curved, facing interior air channels and fitted with horizontally-spaced top and bottom spacers at each end. A pair of sliding horizontal pattern controllers are laterally mounted between the spacers in each of the sliding controller modules and the pattern controllers extend substantially throughout the length of the deflectors in a middle segment thereof. A pair of pivoting pattern controllers are mounted in the pivoting air controlling section between the sliding controller modules in the modular air bar, in order to deflect airflowing through the modular air bag around the air channels and directionally distribute the air through an air slot between the deflectors, into the structure.

U.S. Pat. No. 5,046,405 to Roy discloses an air diffuser adapted to be mounted in a suspended ceiling and connected to the air supply duct of a ventilating system to diffuse air horizontally along the ceiling at an adjustable flow rate. An upper plate is designed to be supported on the rails of a suspended ceiling so as to be leveled with the ceiling tiles. A lower air deflecting plate is suspended from upper plates, the upper plate has a central hole for communicating with the air duct. Baffle plates are hinged to the underside of the upper plate along hinge axis which are parallel to and inwardly spaced from the free peripheral straight edges of the lower plate. The baffle plates can be manually adjusted and are maintained in an adjusted angular position between a fully-opened position in which they rest against the underside of the upper plate and a closed position with their free edges resting on the lower plate. Each baffle plate is independently angularly adjustable, such that the air can be discharged at adjustable volumes and selectively in various directions around the diffuser.

U.S. Pat. No. 5,088,388 to Schaefer discloses an all season, adjustable fresh air intake for agricultural buildings which is adapted to adjust the volume, velocity and direction of fresh air drawn from the outside, through the intake and into the building suitably by exhaust fans. The intake is firstly comprised of a hollow building body. The body extends from outside the building, through a ceiling or wall of the building with an opening extending into the building for bringing fresh air into the building from the outside. An air intake housing with at least one opening is attachable to the building body on the inside of the building at the body opening through which fresh air from outside may flow. A pair of independently adjustable deflectors are pivotally mounted onto the housing adjacent the opening in opposing relationship to each other to manually open and close the opening as well as direct the fresh air from ceiling to floor as the fresh air is drawn into the building through the fresh air intake.

U.S. Pat. No. 5,103,869 to Kimura et al. discloses a piezoelectric on-off valve for air conditioning comprising a bendable metal plate fixed at one end thereof; a valve member mounted on the other end of the metal plate along a ceiling plate, the valve member having vent holes corresponding to vent holes in the ceiling plate, and the valve member changing the relative closure of the vent holes when the metal plate is deformed by application of voltage to the piezoelectric ceramic.

U.S. Pat. No. 5,107,687 to Candeloro discloses a system suitable for air conditioning rooms comprising a heating/cooling unit, distribution pipes and discharge units in the interest of increasing flexibility of installation and operation, constructed in modular fashion, and has a shape that permits installation on top of a suspended ceiling. In addition, the flow of air through each separate discharge unit can be individually adjusted.

U.S. Pat. No. 5,107,755 to Leban et al. discloses a ceiling-mounted air diffuser apparatus in which a annular discharge opening is effectively defined at a location between an effective inner margin of a drop-ceiling-supporting framework and surrounding ceiling panels and an inwardly spaced adjacent outer margin of an intermediate, generally similarly shaped but smaller, ceiling panel positioned in a symmetrically centered location within the large vertical ceiling opening. An enclosing upper hood forming a diffuser provided with a source of air under pressure directed against the upper side of the diffuser panel and outwardly toward a downwardly and outwardly inclined, effectively diverging, air-flow-smoothing channel lying within the air plenum chamber and communicating at its bottom, output end with the annular discharge opening, and being so positioned and so directed and having a bottom appearance, relative to the corresponding diffuser panel outer margin spaced therebelow, such as to be substantially, effectively invisible from below and, consequently, greatly reducing the saliency of the annular discharge opening, while minimizing non-productive energy losses in the nearly horizontally discharged air.

U.S. Pat. No. 5,156,569 to Muller et al. discloses a ceiling outlet and process for producing same provided with outlet slits and air deflector slats for blowing supply air from an air-guide system into a room, wherein mountings for holding slats are bent in a metal sheet, a steel plate or a plate of another material.

U.S. Pat. No. 5,194,042 to Clark discloses a linear slot diffuser for distributing air from a duct into or out of a room. The diffuser includes a frame forming a channel with a plurality of spaced plastic or vinyl supports disposed therein. The supports allow controller blades to be easily positioned in different angular arrangements to change the direction of airflow. The supports are preferably constructed with a plastic or vinyl material and function as a bearing surface.

U.S. Pat. No. 5,215,284 to Hungerford discloses support clips for mounting a modular air bar in the wall or ceiling system of a structure, which modular air bar is characterized by a pair of spaced air deflectors having curved, facing interior air channels and fitted with horizontally-spaced top and bottom spacers at each end. Ceiling clips serve to engage the ceiling and air bar in a wall ceiling installation and wall clips are shaped for mounting on the wall of a structure when the air bar is installed in a ceiling adjacent to a wall.

U.S. Pat. No. 5,216,857 to Petterson et al. discloses a ceiling vent that diffuses air from a heating or cooling system in a laminar flow into a room for optimum dispersion in the room. Inlet air strikes a hinged vane within the vent. The vane deflects the air in a narrowing air way along a continuous concave curvature and extending all the way to the outlet opening of the vent. The vane responds to the force of airflow to narrow or enlarge the air way and, thus, regulate the velocity of air exiting the vent. A curved air catch associated with the vane directs the outflow of air and also laterally disperses air within the vent. The vent maintains a relatively constant velocity and diffusion of air into a room despite variable flow rates from the source of air.

U.S. Pat. No. 5,297,326 to Kline discloses an apparatus and method for converting a fixed-opening air diffuser to an individually-controlled variable air volume diffuser. The fixed-opening diffuser includes a diffuser housing mounted to a support structure and coupled to receive air from a supply conduit positioned behind the support structure and a diffusion assembly mounted across the housing to distribute the air from the housing. The method includes the steps of removing the diffusion assembly from a position across the diffuser housing to provide access to the housing. A thermally-powered diffuser actuator assembly has a movable vane coupled to actuator assembly inside the diffuser housing in a position for control of air discharged from the diffuser housing by thermally-driven displacement of the vane. Each of the steps of removing and mounting is accomplished while maintaining the diffuser housing in place in the support structure while maintaining the support structure in a substantially undisturbed state to minimize the release of dangerous materials possibly present in the support structure .

U.S. Pat. No. 5,433,662 to Hungerford discloses an air bar for mounting in the ceiling system of a structure. The air bar is characterized by a pair of inwardly facing, angled and spaced air deflectors fitted with horizontally shaped top and bottom spacers at each end thereof A barbell shaped pattern controller is laterally slidably mounted between the spacers and extends substantially throughout the length of the air deflectors, to deflect airflowing through the air bar and directionally distribute the air through an air slot between the air deflectors, into the structure.

U.S. Pat. No. 5,447,471 to McDermott discloses an airflow controller having an adjustable airflow passageway and comprises a surface-mounted distribution frame housing one or more elongate passages. Each passage has an inlet, a flow channel and an outlet. The inlet has two opposed guide flaps to control the flow of air passing into the flow channel. Two opposed wall members define the width of the channel, the wall members being adapted to be position-adjusted on control movement of the guide flaps with the outer ends of the wall members defining the outlet.

U.S. Pat. No. 5,569,078 to Kirkpatrick discloses a diffuser introducing air into a conditioned space to obtain a desired indoor atmospheric environment. The diffuser has a diffuser body and an inlet through the diffuser body. The inlet has an inlet area to receive the air within the diffuser. The diffuser has a primary outlet through the diffuser body. The primary outlet has a fixed primary area to direct air from within the diffuser into the conditioned space. The diffuser has a secondary outlet through the diffuser body. The secondary outlet is provided to direct the air from within the diffuser into the conditioned space. The secondary outlet has a secondary area that is adjustable in size between a predetermined minimum secondary area and a predetermined maximum secondary area. The predetermined minimum area may be chose to be zero to provide for a fully closed secondary outlet when the secondary area is adjusted to its minimum area. The diffuser may be implemented with a plurality of primary outlets and a plurality of secondary outlets.

U.S. Pat. No. 5,577,958 to Kumekawa et al. discloses a wind direction adjusting device which includes a wind speed uniforming unit provided upstream of a wind path having a nonuniform wind speed distribution from the side of high wind speed to the side of low wind speed, and a blow-off opening provided downstream of the wind path, which includes a wind direction deflecting plate for deflecting the blow-off direction of the blown-off wind. Further, the wind speed uniforming unit includes a deflecting guide provided on a wind path wall on the side of the high wind speed for deflecting blown-off wind toward a wind path center portion; a wind path wall portion on the side opposite deflecting guide, the shape of which is changed in accordance with the shape of the deflecting guide so that the section area of the wind path is substantially uniform; and an enlarged wind path portion provided immediately after the downstream side end portion of the deflecting guide, the enlarged wind path portion serving to return the blown-off wind from the wind path center portion to the wind path wall downstream the deflecting guide on the side of the deflecting guide.

U.S. Pat. No. 5,667,437 to Donnelly discloses an air diffuser for diffusing conditioned air into a room having a diffuser body mounted in a housing to define an air channel which narrows towards the outlet end of the housing to produce a venturi-like effect causing the air to speed up as it leaves the diffuser so that the conditioned air can penetrate stratified layers of air in the room. The diffuser body is of tapered form having a narrow upper end portion and a wider lower end portion disposed in the open, outlet end of the housing. The diffuser body has a surface which faces the internal surface of a sloping side wall of the housing and which is inclined at an angle to the vertical greater than that of the sloping side wall of the housing to provide the narrowing air channel. The diffuser body is adjustably mounted for movement relative to the housing so that the flow of conditioned air leaving the outlet end of the housing can be adjusted.

Therefore, it is an object of the present invention to provide an improved air diffuser for an air distribution system that overcomes the inadequacies of the prior art and provides a significant advancement to the air diffuser art.

Another object of this invention is to provide an improved air diffuser for an air distribution system that may be installed in a vertical surface, a horizontal surface or an angular oriented surface.

Another object of this invention is to provide an improved air diffuser for an air distribution system that may be installed in a linear, conical or curved manner.

Another object of this invention is to provide an improved air diffuser for an air distribution system that provides a variety of airflow magnitudes and airflow directions.

Another object of this invention is to provide an improved air diffuser for an air distribution system that is capable of controlling the rate of airflow and the direction of airflow through the improved air diffuser.

Another object of this invention is to provide an improved air diffuser for an air distribution system that is adaptable for a wide variety of installations and application.

Another object of this invention is to provide an improved air diffuser for an air distribution system that may be adapted for custom installations and application on site.

Another object of this invention is to provide an improved air diffuser for an air distribution system that is easy to install and is cost effective.

Another object of this invention is to provide an improved air diffuser for an air distribution system that has an aesthetically pleasing appearance.

Another object of this invention is to provide an improved air diffuser for an air distribution system incorporating an improved mounting clip for mounting the improved air diffuser. Another object of the present invention is to provide an improved air diffuser for an air distribution system comprising a decorative portion for simulating a molding when the improved air diffuser is disposed adjacent to a junction of a horizontal surface with a vertical surface.

Another object of the present invention is to provide an improved air diffuser for an air distribution system comprising a decorative portion having a generally triangular cross-section for simulating a molding when the first border is disposed adjacent to a junction of a wall and a ceiling.

Another object of the present invention is to provide improved mounting support for mounting an air diffuser to a structure comprising an arcuate mounting support for mounting the air diffuser to a structure.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved air diffuser for an air distribution system comprising a first and a second border member. Plural spreaders interconnect the first and second border members thereby defining an airflow aperture therebetween. A pattern controller is slidably disposed between the plural spreaders for controlling the volume of airflow through the airflow aperture. The pattern controller is pivotable within the airflow aperture for controlling the direction of airflow through the airflow aperture.

In a more specific embodiment of the invention, each of the plural spreaders comprises a first and a second spreader element. A spreader spring coacts between the first and second spreader elements for interconnecting the first and second border members. The pattern controller is disposed between the spreader spring and one of the first and second spreader elements.

Preferably, the pattern controller comprises a first and a second pattern controller. Each of the first and second pattern controllers is slidable independently for controlling the volume of airflow through the airflow aperture. Each of the first and second pattern controllers is pivotable independently for controlling the direction of airflow through the airflow aperture.

In one embodiment of the invention, the pattern controller comprises a linear component and an angular component. The linear component is slidably disposed between the spreader spring and one of the first and second spreader elements for controlling the volume and/or direction of airflow through the airflow aperture. The angular component is pivotable within the airflow aperture for controlling the volume and/or direction of airflow through the airflow aperture. The angular component may be pivotably mounted to the linear component.

In another embodiment of the invention, each of the plural spreaders comprises a first and a second spreader element. The pattern controller comprises a first and a second pattern controller. The first and second pattern controller is disposed between said plural spreaders, Each of said first and second pattern controllers includes plural control clips located on opposed ends of each of said first and second pattern controllers. Each of said first and second pattern controllers having a linear component and an angular component. The plural control clips of said first and second pattern controllers is slidable between said plural spreaders for sliding said linear components of said first and second pattern controllers within said airflow aperture for controlling the volume of airflow through said airflow aperture. The angular components of said first and second pattern controllers are pivotably mounted to the plural control clips for pivoting the angular components of the first and second pattern controllers within the airflow aperture for controlling the direction of airflow through the airflow aperture. The invention is also incorporated into an improved pattern controller comprising generally planar component formed from a plurality of interconnected longitudinally extending cylindrical elements. Preferably, the plurality of interconnected longitudinally extending cylindrical elements are formed as a unitary component such as an extrusion.

The invention is also incorporated into an improved air diffuser for an air distribution system comprising a first and a second border member. The first border has a decorative portion for simulating a molding when the border is disposed adjacent to a junction of a horizontal surface with a vertical surface. Preferably, the decorative portion has a generally triangular cross-section for simulating a molding when the first border is disposed adjacent to a junction of a wall and a ceiling. The generally triangular cross-section has a hollow center. Preferably, the decorative portion is unitary with the first border as a one piece extruded assembly.

The invention is also incorporated into an improved mounting support for mounting an air diffuser to a structure comprising an arcuate mounting support extending between a first and a second end. The first end of the arcuate mounting support is securable to the outer groove of one the first and second border members. The second end of the arcuate mounting support is securable to the structure for mounting the air diffuser to a structure. Preferably, the arcuate mounting support is formed as a unitary component.

The invention is also incorporated into an improved pattern controller comprising generally planar component formed from a plurality of interconnected longitudinally extending cylindrical elements. Preferably, the plurality of interconnected longitudinally extending cylindrical elements are formed as a unitary component such as an extrusion.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
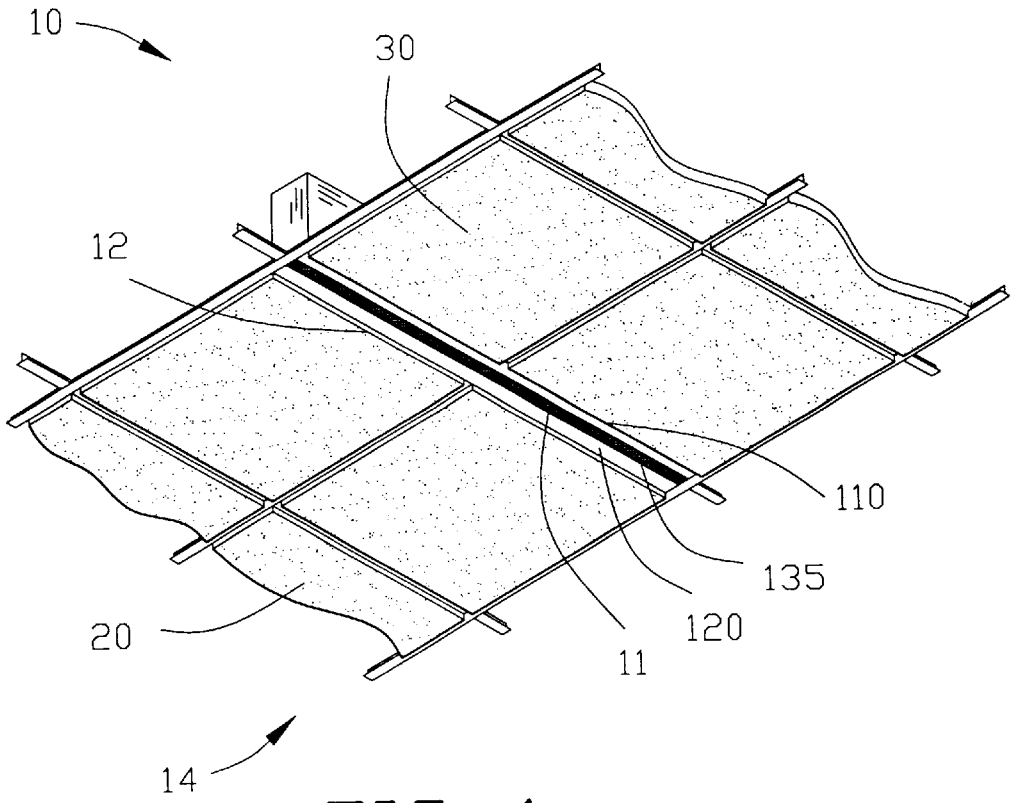
FIG.1 is a bottom isometric view of the improved air diffuser for an air distribution system of the present invention incorporated into a ceiling of a building stricture.
Figure 2:
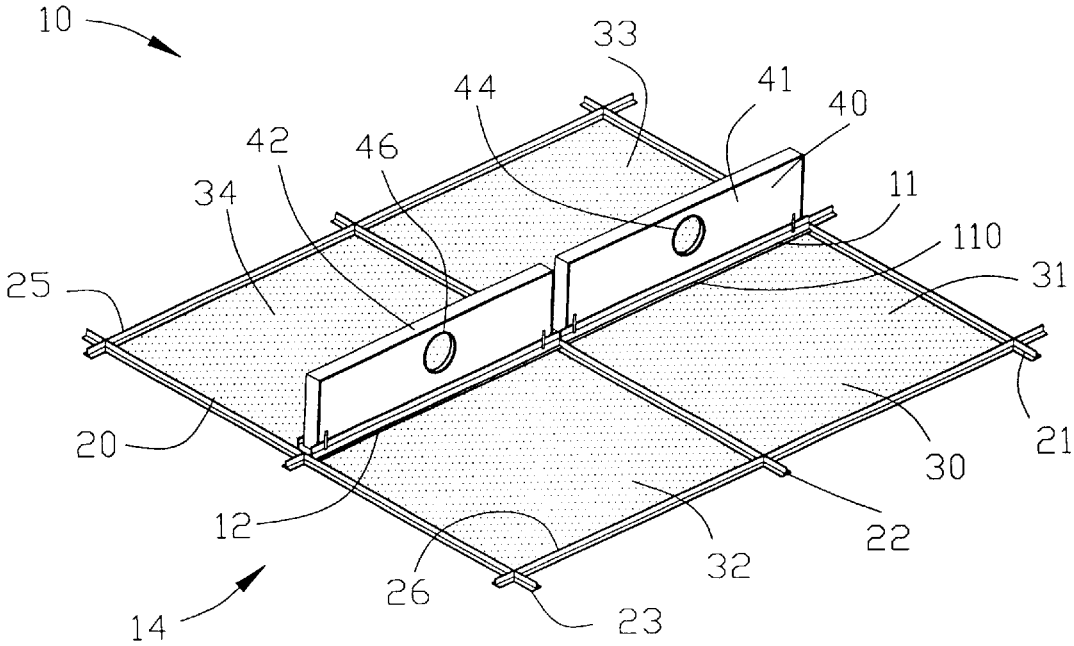
FIG. 2 is a top isometric view of FIG. 1.

FIGS. 1 and 2 are isometric bottom and top views of the improved air diffuser 10 of the present invention. The improved air diffuser 10 comprises a first and a second air diffuser 11 and 12 for providing airflow to a space 14. The first and second air diffusers 11 and 12 are installed in an adjacent relationship within a ceiling 20. The first and second air diffusers 11 and 12 provide airflow to the space 14 located below the ceiling 20.

In this example of the invention, the ceiling 20 is shown as a suspended ceiling having a plurality of T-bars 21–23 and a plurality of cross T-bars 25–26. The ceiling 20 comprises a plurality of the ceiling panels 30 including ceiling panels 31–34. The first and second air diffusers 11 and 12 are installed within removed portions of the ceiling panels 31–34. Although the ceiling 20 has been shown as a suspended ceiling 20, the improved air diffuser 10 of the present invention may be installed in other types of ceilings, walls and the like.

An air plenum 40 provides airflow to the improved air diffuser 10. In this example of the invention, the air plenum 40 is shown as a first and a second air plenum 41–42 for providing airflow to the first and second air diffusers 11 and 12, respectively. The first and second air plenums 41–42 receive airflow from air ducts (not shown) connected to apertures 44–46 of the first and second air plenums 41–42. Although the improved air diffuser 10 has been shown as providing airflow to the space 14, it should be understood that the improved air diffuser 10 of the present invention may be used to provide a return and/or exhaust airflow path from the space 14.

Figure 3:
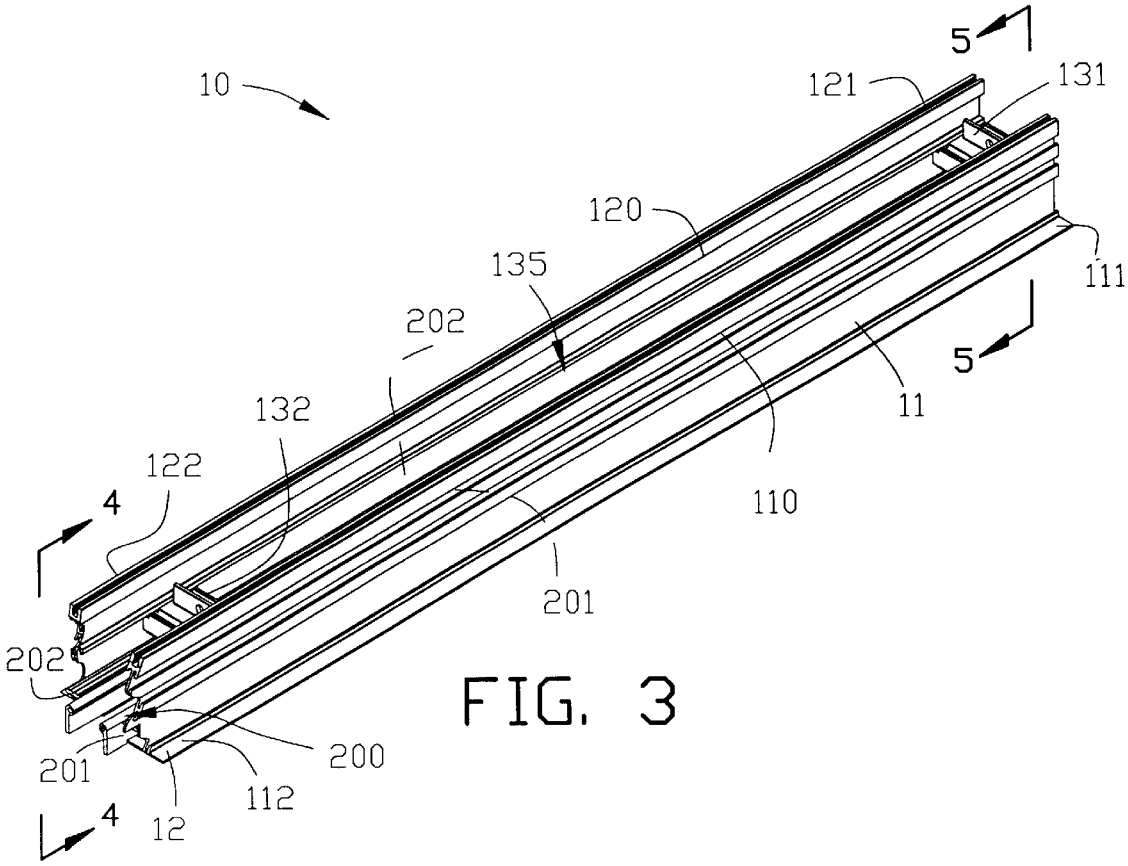
FIG. 3 is a top isometric view of a first embodiment of the improved air diffuser of FIGS. 1 and 2.

FIG. 3 is an isometric view of the improved air diffuser 10 of FIGS. 1 and 2. The improved air diffuser 10 includes the improved air diffuser 11 and a portion of the improved air diffuser 12. The improved air diffuser 11 is identical to the improved air diffuser 12. The improved air diffuser 10 comprises a first and a second border member 110 and 120. The first border member 110 is a longitudinal member extending between a first end 111 and a second end 112. The second border member 120 is a longitudinal member extending between a first end 121 and a second end 122. The first and second border members 110 and 120 extend in a substantially parallel relationship. The first and second border members 110 and 120 are identical to one another and are formed from severing identical first and second border members 110 and 120 from a metallic extrusion. The extrusion may be severed as a factory process or may be severed by an operator to a desired length on location.

Figure 4:
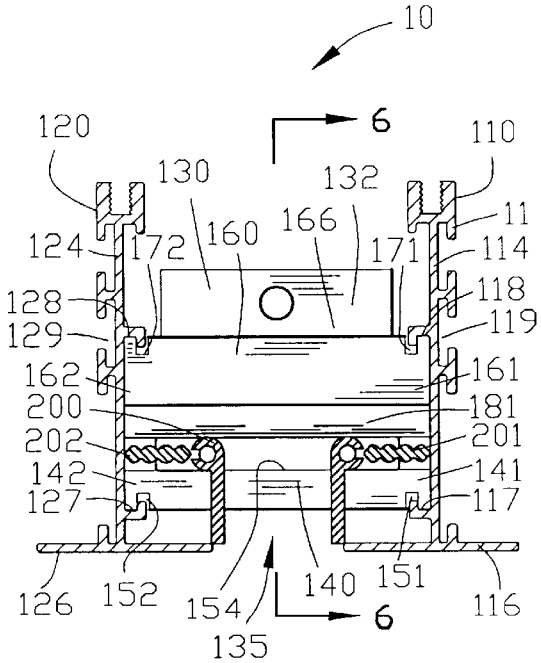
FIG. 4 is an end view along line 4—4 in FIG. 3.
Figure 5:
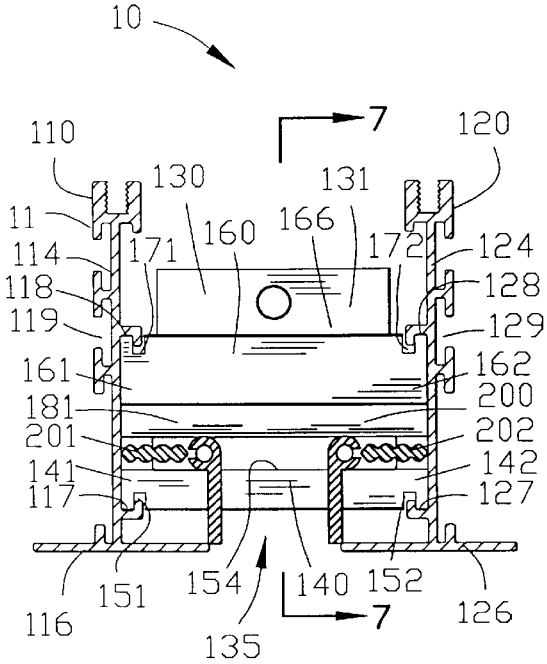
FIG. 5 is an end view along line 5—5 in FIG. 3.

FIGS. 4 and 5 arc end views of FIG. 3. The first border member 110 is shown as an inverted T comprising a major strut 114 with a minor strut 116 disposed perpendicularly to the major strut 114. The first border member 110 includes a first and a second groove 117 and 118 extending between the first and second ends 111 and 112. The second border member 120 includes a second outer groove 129.

The second border member 120 is shown as an inverted T comprising a major strut 124 with a minor strut 126 disposed perpendicularly to the major strut 124. The second border member 120 includes a first and a second groove 127 and 128 extending between the first and second ends 121 and 122. The first border member 110 includes a first outer groove 119.

The improved air diffuser 10 includes plural spreaders 130 interconnecting the first and second border members 110 and 120 thereby defining an airflow aperture 135 therebetween. The plural spreaders 130 are shown as two spreaders 131 and 132 in FIGS. 3 and 8. In a typical installation, plural spreaders 130 are required for each of the improved air diffusers 11 and 12. The plural spreaders 130 are intermittently spaced along the first and second border members 110 and 120 at preselected distances for each of the improved air diffusers 11 and 12. Preferably, the spreaders 131 and 132 are identical to one another. The spreaders 131 and 132 may be formed from severing identical spreaders 131 and 132 from a metallic extrusion. In the alternative, the spreaders 131 and 132 ma precut to a standard length by the manufacturer.

Figure 7:
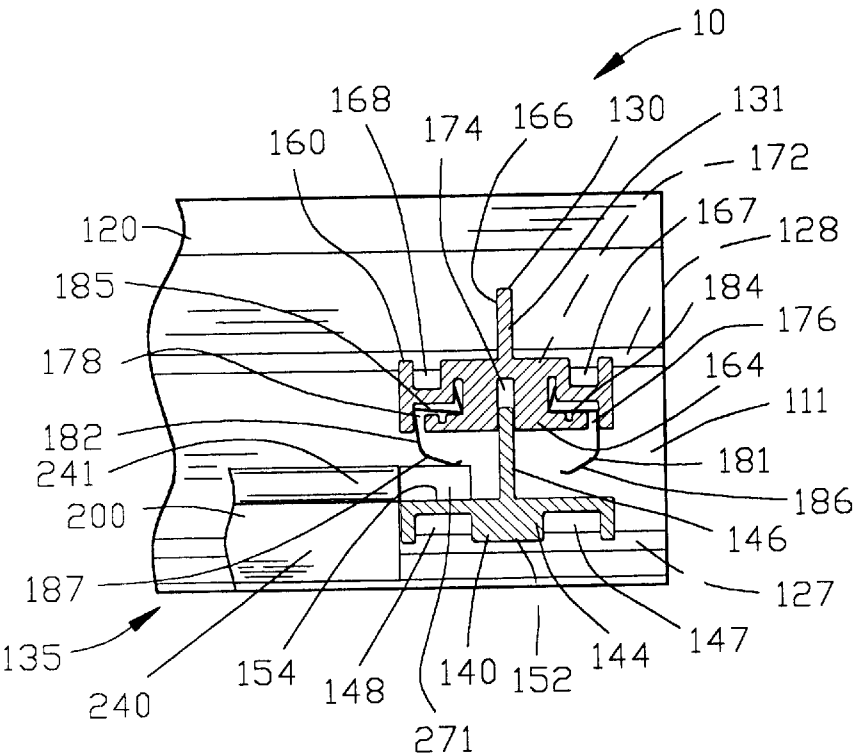
FIG. 7 is a sectional view along line 7—7 in FIG. 5.
Figure 6:
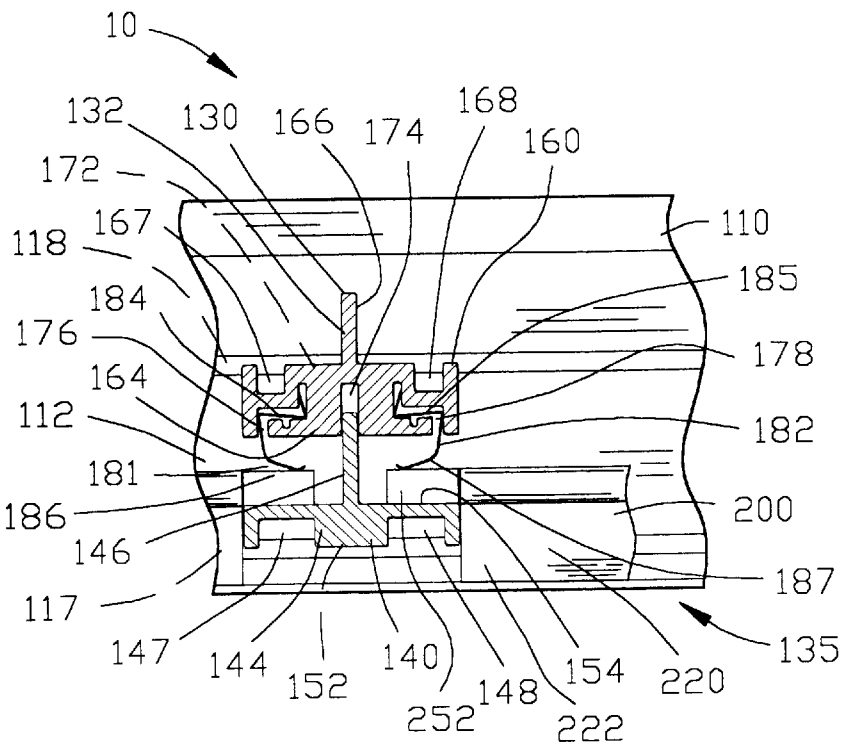
FIG. 6 is a sectional view along line 6—6 in FIG. 4.

FIGS. 6 and 7 are sectional views the spreaders 131 and 132 shown in FIGS. 4 and 5. Each of the plural spreaders 131 and 132 comprises a first spreader element 140 and a second spreader element 160.

The first spreader element 140 extends between a first and a second end 141 and 142. The first and second ends 141 and 142 are located adjacent to the first and second border members 110 and 120, respectively. As best shown in FIGS. 6 and 7, the first spreader clement 140 comprises a base 144 and an upstanding wall 146 extending substantially perpendicular to the base 144. The base 144 defines plural recesses 147 and 148 extending along the base 144. The plural recesses 147 and 148 reduce the amount required for the first spreader element 140 without substantially affecting the strength of the first spreader element 140.

Referring back to FIGS. 4 and 5, the first and second ends 141 and 142 of the first spreader element 140 are provided with cross-slots 151 and 152 for cooperating with the first grooves 117 and 127 of the first and second border members 110 and 120, respectively. The first spreader element 140 includes a sliding surface 154 for movably mounting a panel controller 200 as will be described in greater detail hereinafter.

The second spreader element 160 extends between a first and a second end 161 and 162. The first and second ends 161 and 162 are located adjacent to the first and second border members 110 and 120, respectively. As best shown in FIGS. 6 and 7, the second spreader element 160 comprises a base 164 and an upstanding wall 166 extending substantially perpendicular to the base 164. The base 164 defines plural recesses 167 and 168 extending along the base 164. The plural recesses 167 and 168 reduce the amount required for the second spreader element 160 without substantially affecting the strength of the second spreader element 160.

Referring back to 4 and 5, the first and second ends 161 and 162 of the second spreader element 160 are provided with first and second cross-slots 171 and 172. The first and second cross-slots 171 and 172 cooperate with the second grooves 118 and 128 of the first and second border members 110 and 120, respectively. The second spreader element 160 includes a longitudinally extending void 174 for slidably receiving the upstanding wall 146 of the first spreader element 140. The cooperation between the upstanding wall 146 of the first spreader element 140 and the longitudinally extending void 174 of the second spreader element 160 maintains the alignment of the first spreader element 140 relative to the second spreader element 160.

As best shown in FIGS. 6 and 7, the second spreader element 160 is provided with plural sockets 176 and 178 extending between the first and second ends 161 and 162 of the second spreader element 160. Each of the plural sockets 176 and 178 defines a tortuous path for retaining plural spreader springs 181 and 182 therein.

Figure 8:
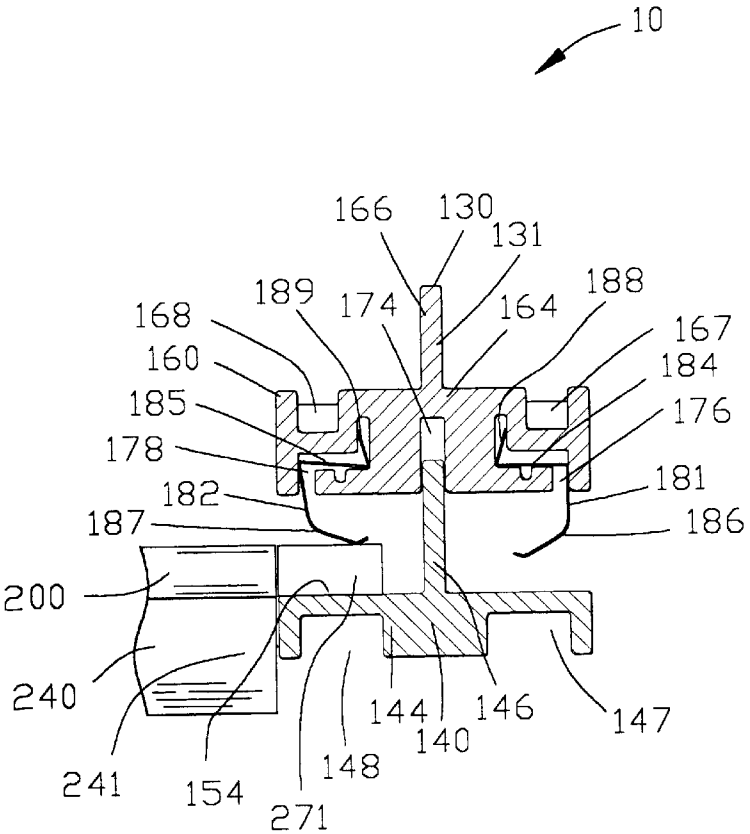
FIG. 8 is an enlarged view of a portion of FIG. 7.

FIG. 8 is an enlarged view of a portion of FIG. 7 further illustrating the spreader springs 181 and 182. Each of the spreader springs 181 and 182 comprises spring bases 184 and 185 and spring projections 186 and 187. The spring bases 184 and 185 are received and retained within the plural sockets 176 and 178 of the second spreader element 160. The spring bases 184 and 185 include tail portions 188 and 189 providing a resilient interference fit with the tortuous paths of plural sockets 176 and 178 to retain the spring bases 184 and 185 within the plural sockets 176 and 178.

The spring projections 186 and 187 of the spreader springs 181 and 182 extend outwardly from the second spreader element 160. When the upstanding wall 146 of the first spreader element 140 is slidably received within the longitudinally extending void 174 of the second spreader element 160, the spring projections 186 and 187 are disposed between the first and second spreader elements 140 and 160. The spring projections 186 and 187 are formed into an arc for providing a resiliency to the spring projections 186 and 187 of the spreader springs 181 and 182. The arc of the spring projections 186 and 187 facilitates in the insertion of the panel controller 200 as will be described in greater detail hereinafter.

The spreader springs 181 and 182 coact between the first and second spreader elements 140 and 160 for interconnecting the first and second border members 110 and 120. The first and second cross-slots 151 and 152 of the first spreader element 140 interconnect with the first grooves 117 and 127 of the first and second border members 110 and 120. The first and second cross-slots 171 and 172 of the second spreader clement 160 interconnect with the second grooves 118 and 128 of the first and second border members 110 and 120. The spreader springs 181 and 182 bias cross-slots 151, 152, 171 and 172 into engagement with the grooves 117, 118, 127 and 128 for enabling the first and second spreader elements 140 and 160 to interconnect the first and second border members 110 and 120.

The pattern controller 200 is movably disposed between the first and second spreader elements 140 and 160 for controlling the volume and the direction of airflow through the airflow aperture 135. In this example of the invention, the pattern controller 200 comprises a first and a second pattern controller 201 and 202.

The first pattern controller 201 comprises a first linear component 210 and a first angular component 220. The first linear component 210 is slidably mounted between the first and second spreader elements 140 and 160 for controlling the volume and direction of airflow through the airflow aperture 135. The first angular component 220 is pivotably mounted for controlling the volume and the direction of airflow through the airflow aperture 135.

The second pattern controller 202 comprises a second linear component 230 and a second angular component 240.

The second linear component 230 is slidably mounted between the first and second spreader elements 140 and 160 for controlling the volume and direction of airflow through the airflow aperture 135. The second angular component 240 is pivotably mounted for controlling the volume and the direction of airflow through the airflow aperture 135.

Figure 9:
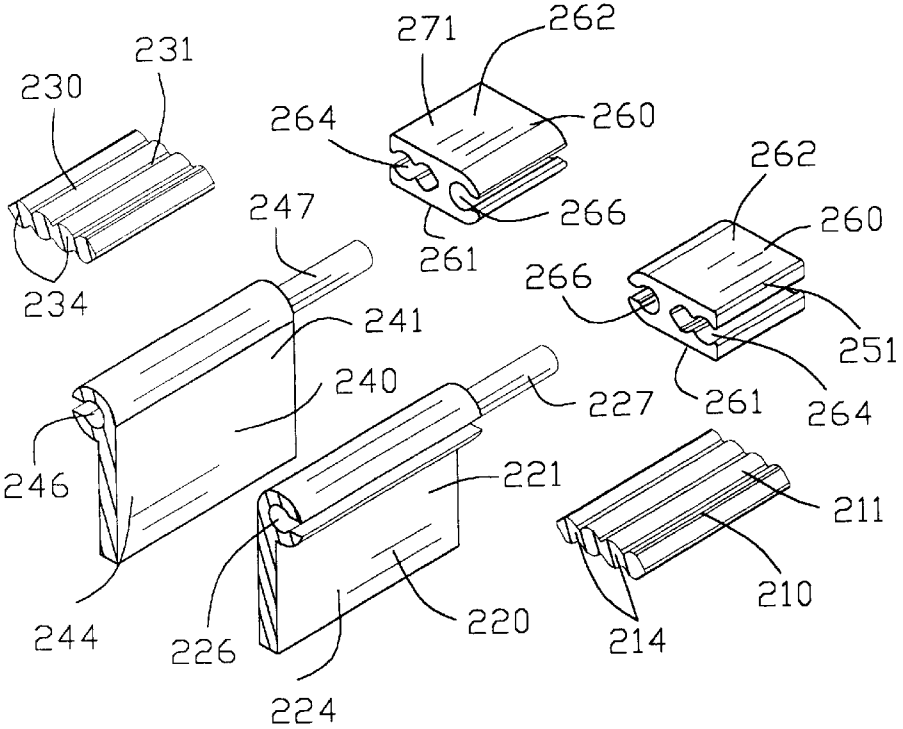
FIG. 9 is an exploded isometric view of a portion of FIGS. 3.
Figure 10:
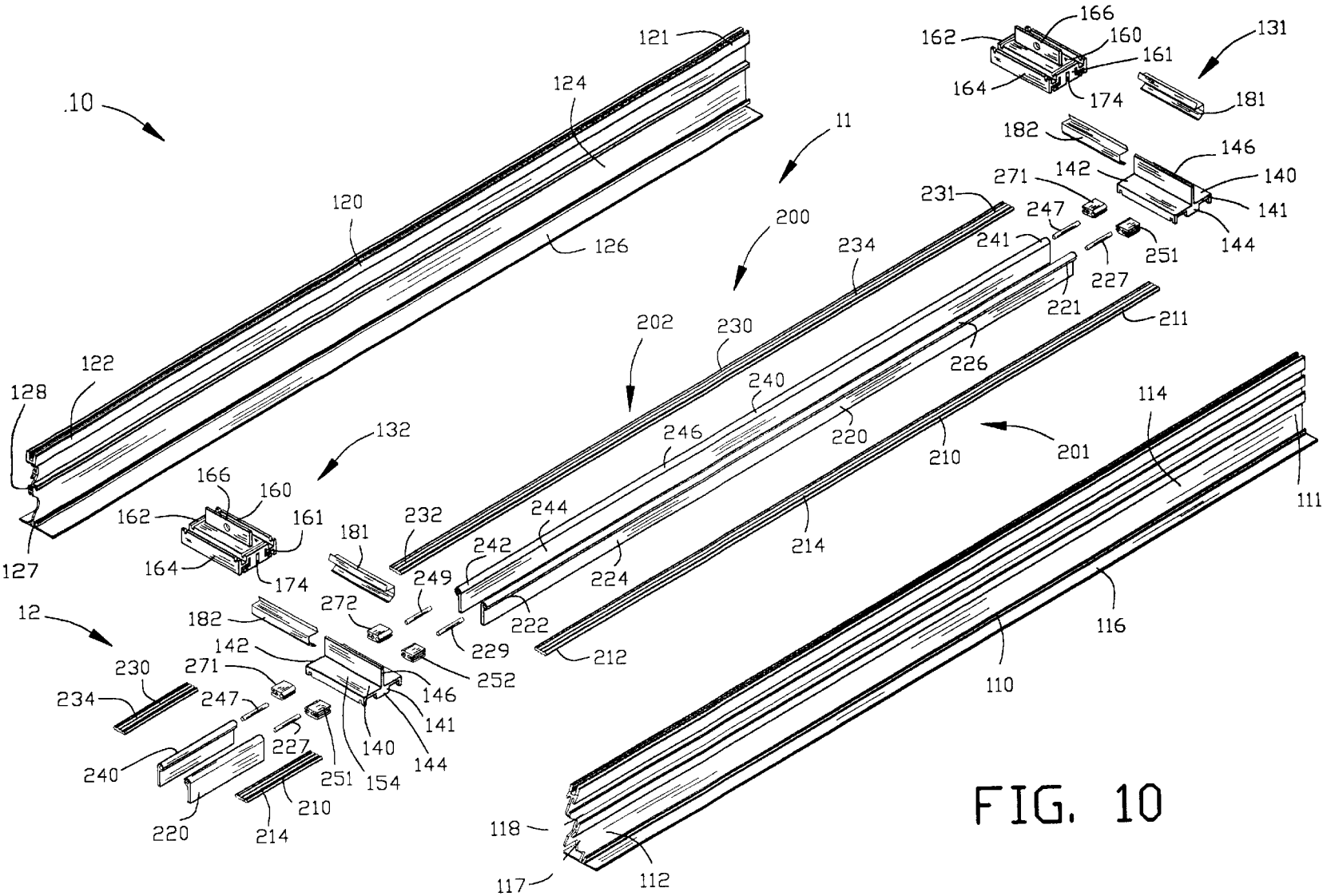
FIG. 10 is an exploded isometric view of the improved air diffuser of FIGS. 3.

FIGS. 9 and 10 are exploded isometric views of the improved air diffuser of FIGS. 3–8. The first linear component 210 of the first pattern controller 201 comprises a generally planar component extending between a first and a second end 211 and 212. The first angular component 220 extends between a first and a second end 221 and 222. The second linear component 230 of the second pattern controller 202 is identical to the first linear component 210. The second linear component 230 comprises a generally planar component extending between a first and a second end 231 and 232. The second angular component 240 is identical to the first angular component 220. The second angular component 240 extends between a first and a second end 241 and 242.

As best shown in FIG. 9, the linear component 210 is formed from a plurality of interconnected cylindrical elements 214. The plurality of interconnected cylindrical elements 214 reduce the weight of the linear component 210 without reducing the mechanical strength. Furthermore, the plurality of interconnected cylindrical elements 214 appears to reduce vibration of the first linear components 210 caused by the airflow through the airflow aperture 135. Preferably, the first linear component 210 is formed through an extrusion process for creating the plurality of interconnected cylindrical elements 214 as a unitary component. In one example, each of the plurality of interconnected cylindrical elements 214 has a diameter of 0.135 inches with the thickness between adjacent interconnected cylindrical elements 214 being 0.076 inches.

The first angular component 220 extends between a first and a second end 221 and 222. The first angular component 220 comprises a planar portion 224 and a tubular portion 226. The tubular portion 226 receives a first and a second pivot pin 227 and 229 extending from the first and second ends 221 and 222 of the first angular component 220 Preferably, the first angular component 220 is formed from a unitary component. The first and second pivot pins 227 and 229 enable the first angular component 220 to be pivoted within the airflow aperture 135 for controlling the volume and the direction of airflow through the airflow aperture 135.

The second linear component 230 of the second pattern controller 202 is identical to the first linear component 210. The second linear component 230 comprises a generally planar component extending between a first and a second end 231 and 232. The second linear component 230 is formed from a plurality of interconnected cylindrical elements 234.

The second angular component 240 is identical to the first angular component 220. The second angular component 240 extends between a first and a second end 241 and 242. The second angular component 240 comprises a planar portion 244 and a tubular portion 246. The tubular portion 246 receives a first and a second pivot pin 247 and 249 extending from the first and second ends 241 and 242 of the first angular component 240. The first and second pivot pin 247 and 249 enable the second angular component 240 to be pivoted within the airflow aperture 135 for controlling the volume and the direction of airflow through the airflow aperture 135.

In this first embodiment of the invention, the first pattern controller 201 includes first and second control clips 251 and 252 for mounting the first linear component 210 and the first angular component 220 within the airflow aperture 135. The second control clip 252 is identical to the first control clip 251 and will be described with reference to the first control clip 251.

The first control clip 251 includes a body 260 defining a first and a second surface 261 and 262. The first surface 261 is substantially parallel to the second surface 262. The body 260 includes an opening 264 for receiving a portion of the first end 211 of the first-linear component 210. The body 260 includes an orifice 266 for rotatably receiving the first pivot pin 227.

Referring now to FIG. 10, the second pattern controller 202 includes first and second control clips 271 and 272 mounting the second linear component and the second angular component 240 within the airflow aperture 135. The first and second control clips 271 and 272 are identical to the first control clip 251 as described previously.

Figure 11:
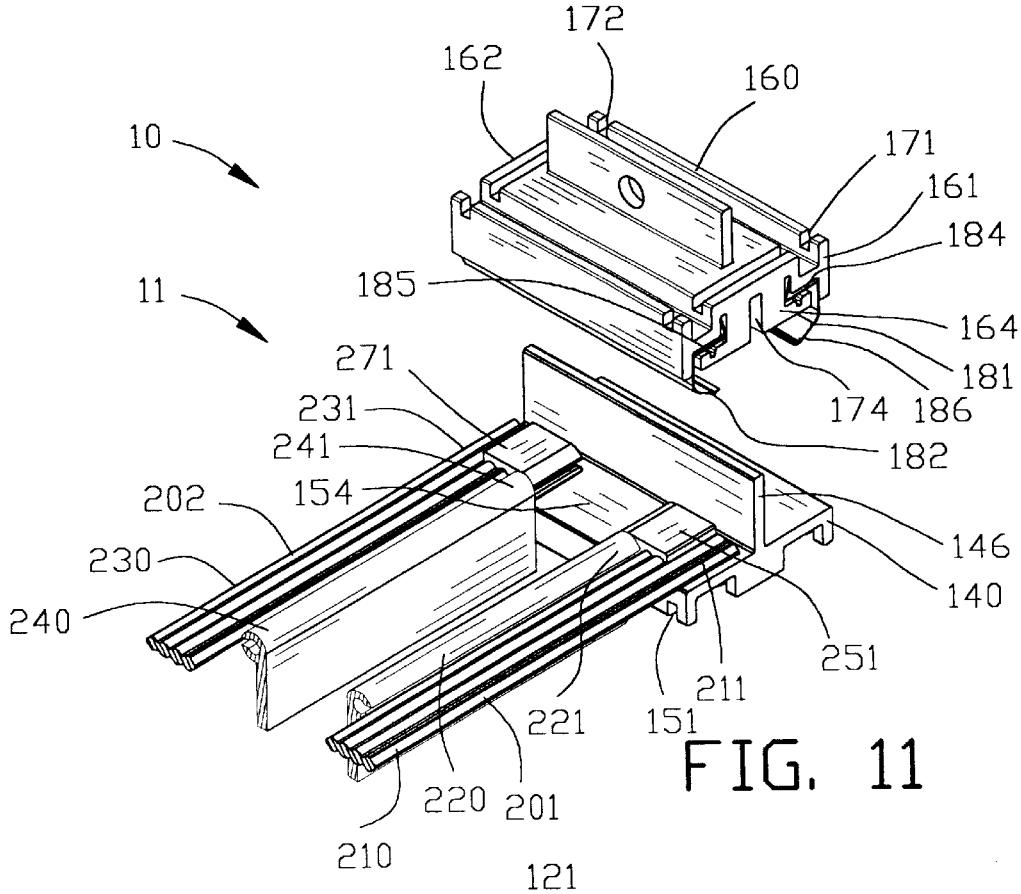
FIG. 11 is an enlarged partially assembled view of a portion of FIGS. 10.
Figure 12:
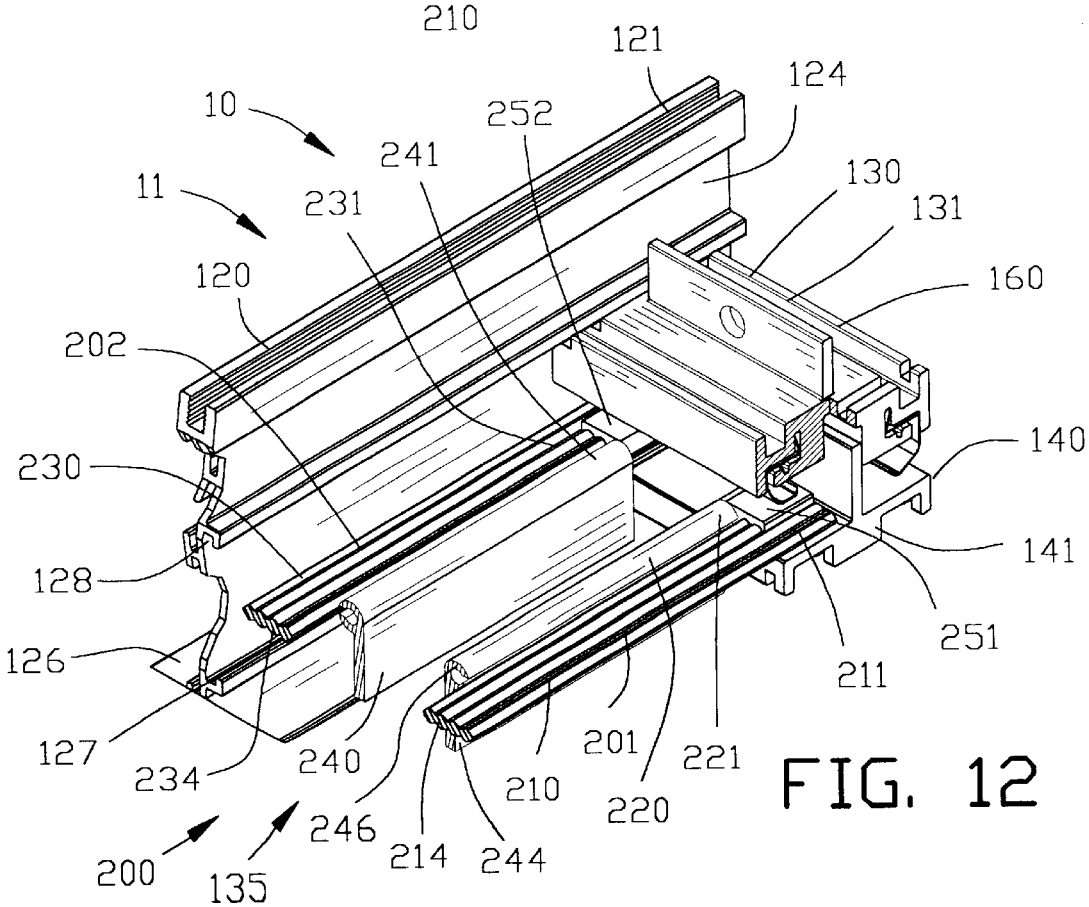
FIG. 12 is a more fully assembled view of FIGS. 11.

FIGS. 11 and 12 are enlarged views of a portion of FIG. 10 in sequentially increasing levels of assembly. The first control clips 251 and 271 of the first and second pattern controllers 201 and 202 are slidably disposed between the first and second spreader elements 140 and 160. The first control clips 251 and 271 are slidable independently between the spreader springs 181 and 182 and the sliding surfaces 154 of the first spreader element 140. The first and second pattern controllers 201 and 202 are slidable independently within the airflow aperture 135.

The first linear component 210 and the first angular component 220 are slidable independently of the second linear component 230 and the second angular component 240. The first angular component 220 is pivotable independently of the second angular component 240. The movement of the first and second linear components 210 and 230 and the first and second angular components 220 and 240 control the volume and the direction of airflow through the airflow aperture 135.

The first and second control clips 251, 252, 271 and 272 of the first and second pattern controllers 201 and 202 are slidable between the plural spreaders 140 and 160. The first and second control clips 251, 252, 271 and 272 slide the linear components 210 and 230 of the first and second pattern controllers 201 and 202 within the airflow aperture 135 for controlling the volume and/or direction of the airflow through the airflow aperture 135. The first and second angular components 220 and 240 of the first and second pattern controllers 201 and 202 are pivotably mounted to the first and second control clips 251, 252, 271 and 272.

Figure 13:
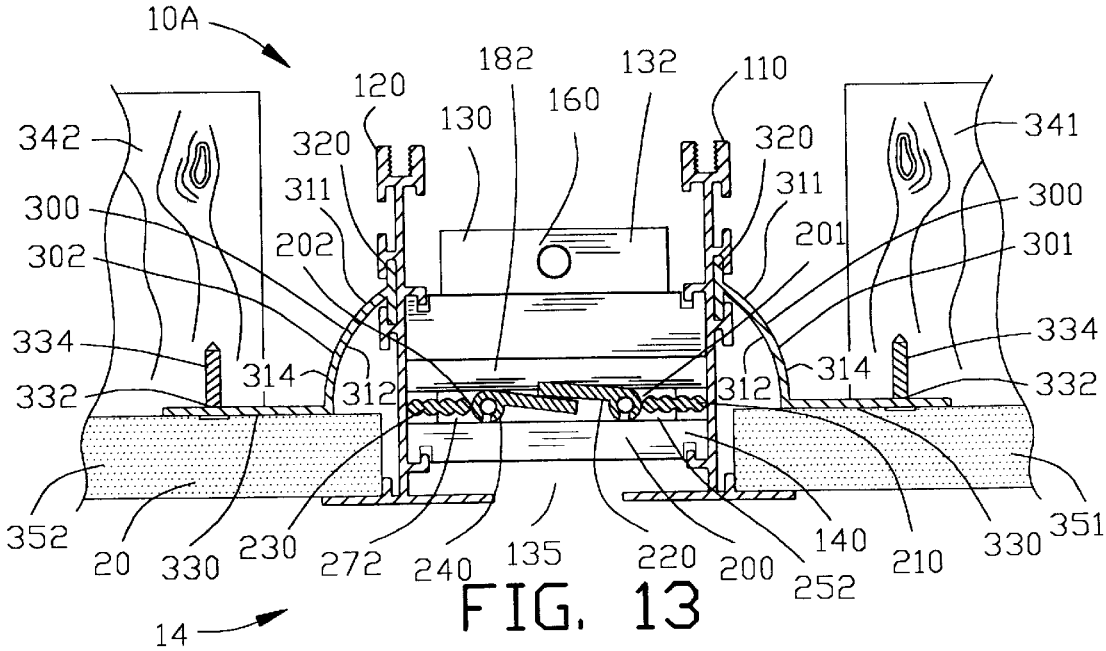
FIG. 13 is an end view similar to FIG. 4 illustrating the improved air diffuser installed in a ceiling and moved into a fully damper position.

FIG. 13 is an end view similar to FIG. 4 illustrating the improved air diffuser 10A installed into the ceiling 20A through the use of an improved mounting support 300 shown as a first and a second mounting support 301 and 302. The first mounting support is identical to the second mounting support 302 and will be explained with reference to the mounting support 301.

The improved mounting support 300 extends between a first end 311 and a second end 312 with an arcuate member 314 located therebetween. The first end 311 includes a border member mounting 320 whereas the second end 312 includes a structure mounting 330. The structure mounting 330 includes a mounting aperture 332. The arcuate member 314 forms a smooth curve between the first end 311 and the second end 312. The arcuate member 314 provides a resiliency or yieldability between the first end 311 and the second end 312 for aiding in the installation of the improved air diffuser 10A. The mounting support 301 may be formed from severing a longitudinal member formed as a metallic extrusion. The extrusion may be severed as a factory process or may be severed by an operator to a desired length on location.

In this example, the improved air diffuser 10A is located between two parallel beams 341 and 342. The border member mountings 320 of each of the first and second mounting supports 301 and 302 are slidably received within the first and second outer grooves 119 and 129 of the first and second border members 110 and 120. The structure mounting 330 of each of the first and second mounting supports 301 and 302 are secured to the two parallel beams 341 and 342 by mechanical fasteners 334 extending through the mounting apertures 332. Preferably, a plurality of the first and second mounting supports 301 and 302 are intermittently spaced along the first and second border members 110 and 120 at preselected distances for mounting the improved air diffusers 10A.

After the improved air diffuser 10A is secured to the parallel beams 341 and 342, a first and second panel 351 and 352 may be moved into engagement with the first and second border members 110 and 120. The first and second panel 351 and 352 may be representative of conventional building material such as sheet rock or the like.

FIG. 13 illustrates the improved air diffuser 10A with the first and second pattern controllers 201 and 202 being shown in the fully closed position. More specifically, the first pattern controller 201 has been move to the right in FIG. 13 until the first linear component 210 contacts the first border member 110. Similarly, the second pattern controller 202 has been moved to the left in FIG. 13 until the second linear component 230 contacts the second border member 120.

The first angular component 220 has been rotated into parallel alignment with the first linear component 210. Similarly, the second angular component 220 has been rotated into a generally parallel alignment with the second linear component 230 and into contact with the first angular component 220. In this arrangement, the improved air diffuser 10A is in a fully dampered position.

The first and second pattern controllers 201 and 202 may be moved by an operator under the bias of the spreader spring 181 and 182. Once the proper adjustment has been made by the operator, the bias of the spreader springs 181 and 182 maintain the position of the first and second linear components 210 and 230 of the first and second pattern controllers 201and 202.

Similarly, the first and second angular components 220 and 240 may be moved by an operator against the friction between the pivot pin 247 and 249 and the first and second angular components 220 and 240 and/or the first and second control clips 271 and 272. Once the proper adjustment has been made by the operator, the friction maintains the position of the first and second angular components 220 and 240 of the first and second pattern controllers 201 and 202.

Figure 14:
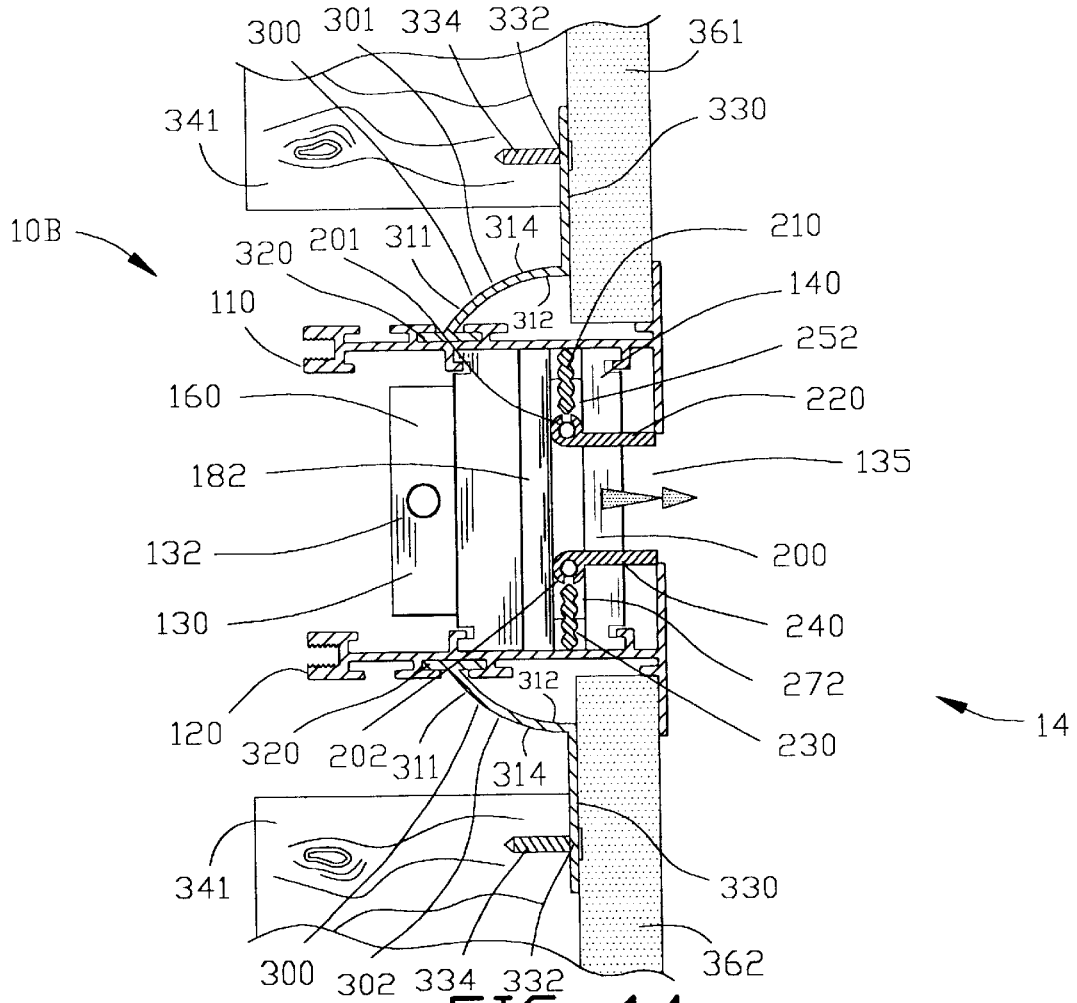
FIG. 14 is an end view similar to FIG. 13 illustrating the improved air diffuser installed in a sidewall.

FIG. 14 is an end view similar to FIG. 13 illustrating an improved air diffuser 10IB installed in a sidewall 360. The sidewall 360 comprises first and second panels 361 and 362 representative of conventional building material such as sheet rock or the like.

FIG. 14 illustrates the improved air diffuser 10B with the first and second pattern controllers 201 and 202 being shown to direct the airflow in a horizontal direction. More specifically, the first pattern controller 201 has been move to the top in FIG. 14 until the first linear component 210 contacts the first border member 110. Similarly, the second pattern controller 202 has been moved to the bottom in FIG. 14 until the second linear component 230 contacts the second border member 120. The first angular component 220 has been rotated to be perpendicular to the first linear component 210. Similarly, the second angular component 240 has been rotated to be perpendicular to the second linear component 230. In this arrangement, the improved air diffuser 10B directs the airflow in a horizontal direction.

Figure 15:
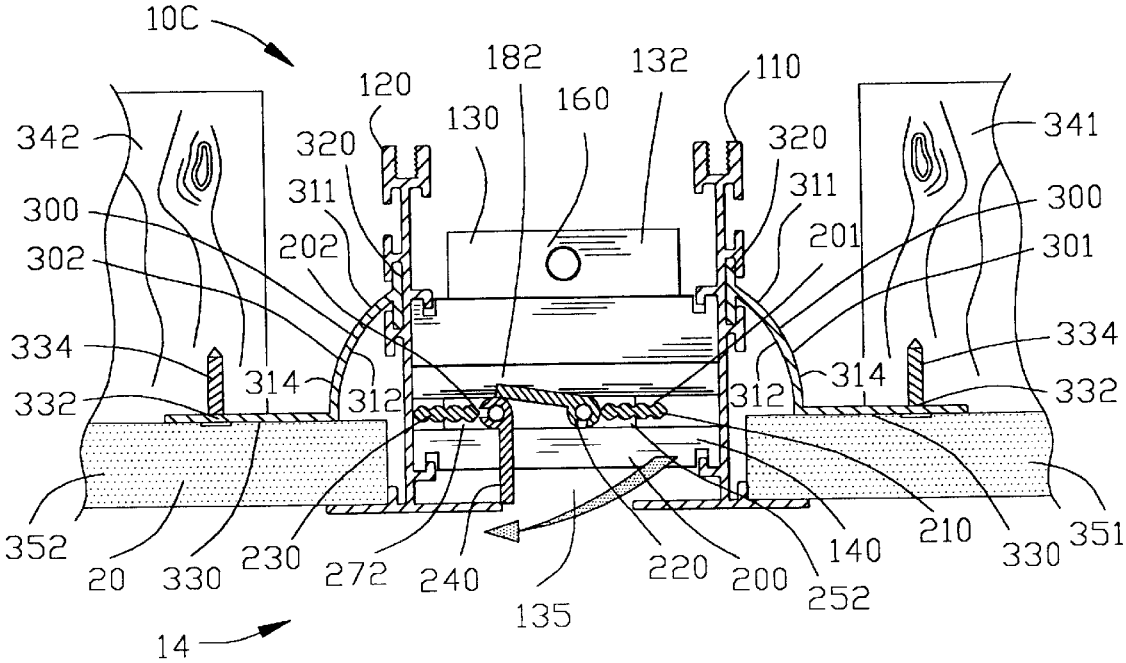
FIG. 15 is an end view similar to FIG. 13 illustrating the improved air diffuser directing airflow toward the left.

FIG. 15 is an end view similar to FIG. 13 illustrating the improved air diffuser 10C directing an airflow toward the left. More specifically, the second pattern controller 202 has been moved to the left in FIG. 15 until the second linear component 230 contacts the second border member 120. The second angular component 240 has been rotated to be perpendicular to the second linear component 230. The first angular component 220 has been rotated to be parallel to the first linear component 210. The first pattern controller 201 has been move to the left in FIG. 15 until the first angular component 220 contacts the second angular component 240. In this arrangement, the improved air diffuser 10C directs the airflow toward the left direction.

Figure 16:
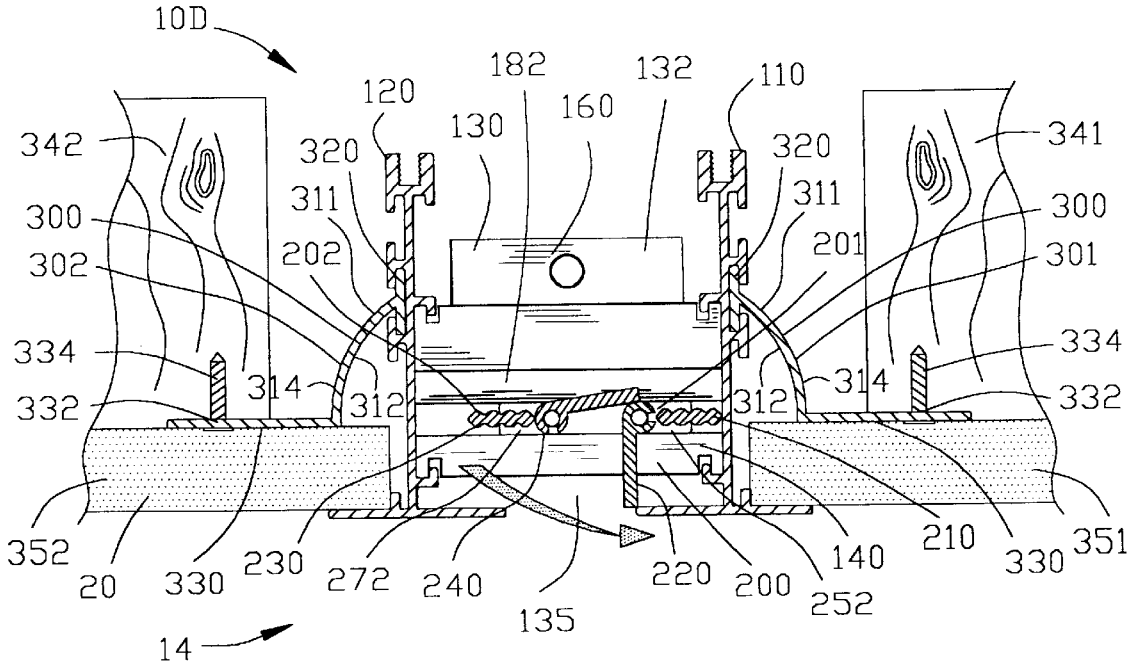
FIG. 16 is an end view similar to FIG. 13 illustrating the improved air diffuser directing airflow toward the right.

FIG. 16 is an end view similar to FIG. 13 illustrating the improved air diffuser 10D directing an airflow toward the right. More specifically, the first pattern controller 201 has been moved to the right in FIG. 16 until the first linear component 210 contacts the first border member 110. The first angular component 220 has been rotated to be perpendicular to the first linear component 210. The second angular component 240 has been rotated to be parallel to the second linear component 230. The second pattern controller 202 has been move to the right in FIG. 16 until the second angular component 240 contacts the first angular component 220. In this arrangement, the improved air diffuser 10D directs the airflow toward the right direction.

Figure 17:
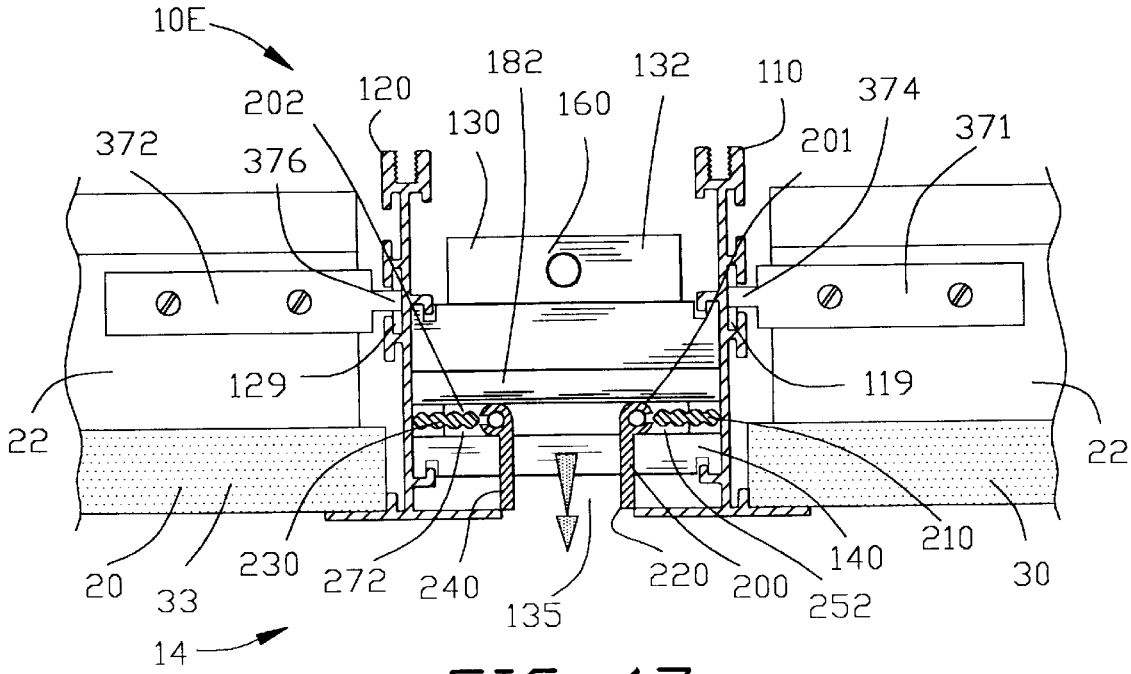
FIG. 17 is an end view similar to FIG. 13 illustrating the improved air diffuser directing airflow in a vertical direction.

FIG. 17 illustrates the improved air diffuser 10E installed in the ceiling 20 shown in FIGS. 1 and 2. In this embodiment of the invention, a first and a second bracket 371 and 372 are secured to the T-bars 22 shown in FIGS. 1 and 2. The first and second brackets 371 and 372 include border member mountings 374 and 376. The border member mountings 374 and 376 are slidably received within the first and second outer grooves 119 and 129 of the first and second border members 110 and 120. The first and second brackets 371 and 372 secure the improved air diffuser 10E to the ceiling 20.

FIG. 17 illustrates the improved air diffuser 10E with the first and second pattern controllers 201 and 202 being shown to direct the airflow in a vertical direction. More specifically, the first pattern controller 201 has been move to the right in FIG. 17 until the first linear component 210 contacts the first border member 110. Similarly, the second pattern controller 202 has been moved to the left in FIG. 17 until the second linear component 230 contacts the second border member 120. The first angular component 220 has been rotated to be perpendicular to the first linear component 210. Similarly, the second angular component 240 has been rotated to be perpendicular to the second linear component 230. In this arrangement, the improved air diffuser 10E directs the airflow in a vertical direction.

Figure 18:
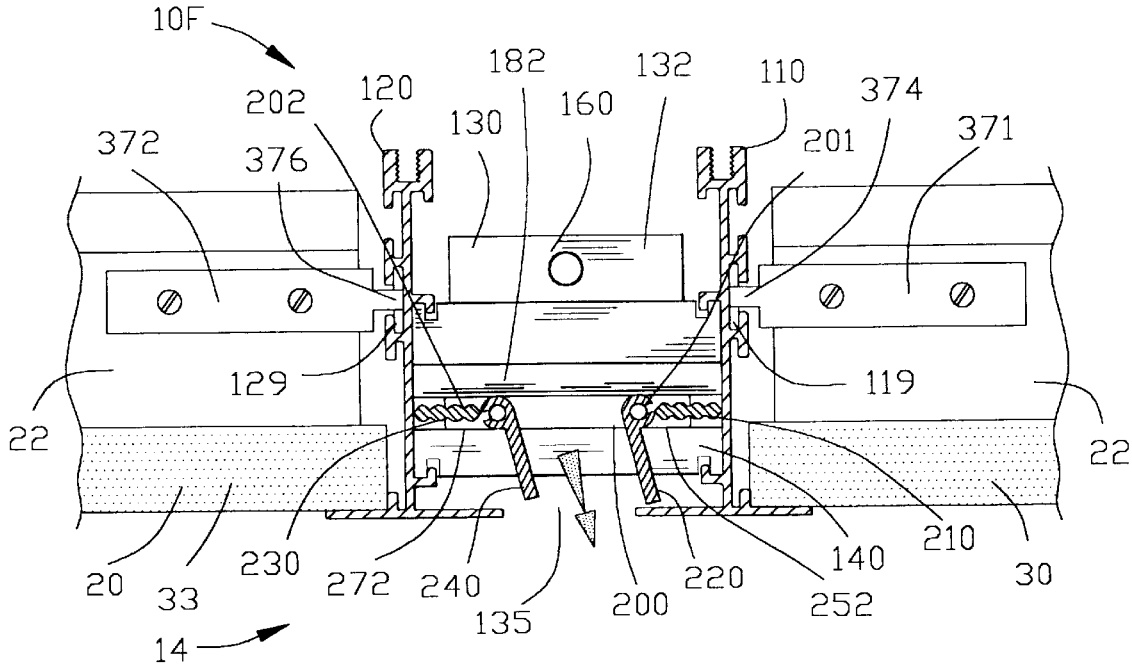
FIG. 18 is an end view similar to FIG. 13 illustrating the improved air diffuser directing airflow in a vertical and right direction.

FIG. 18 illustrates the improved air diffuser 10F with the first and second pattern controllers 201 and 202 being shown to direct the airflow in a vertical right direction. More specifically, the first pattern controller 201 has been move to the right in FIG. 18 until the first linear component 210 contacts the first border member 110. Similarly, the second pattern controller 202 has been moved to the left in FIG. 18 until the second linear component 230 contacts the second border member 120. The first angular component 220 has been rotated to be to the right of a perpendicular to the first linear component 210. Similarly, the second angular component 240 has been rotated to be to the right of a perpendicular to the second linear component 230. In this arrangement, the improved air diffuser 10F directs the airflow in a vertical right direction.

Figure 19:
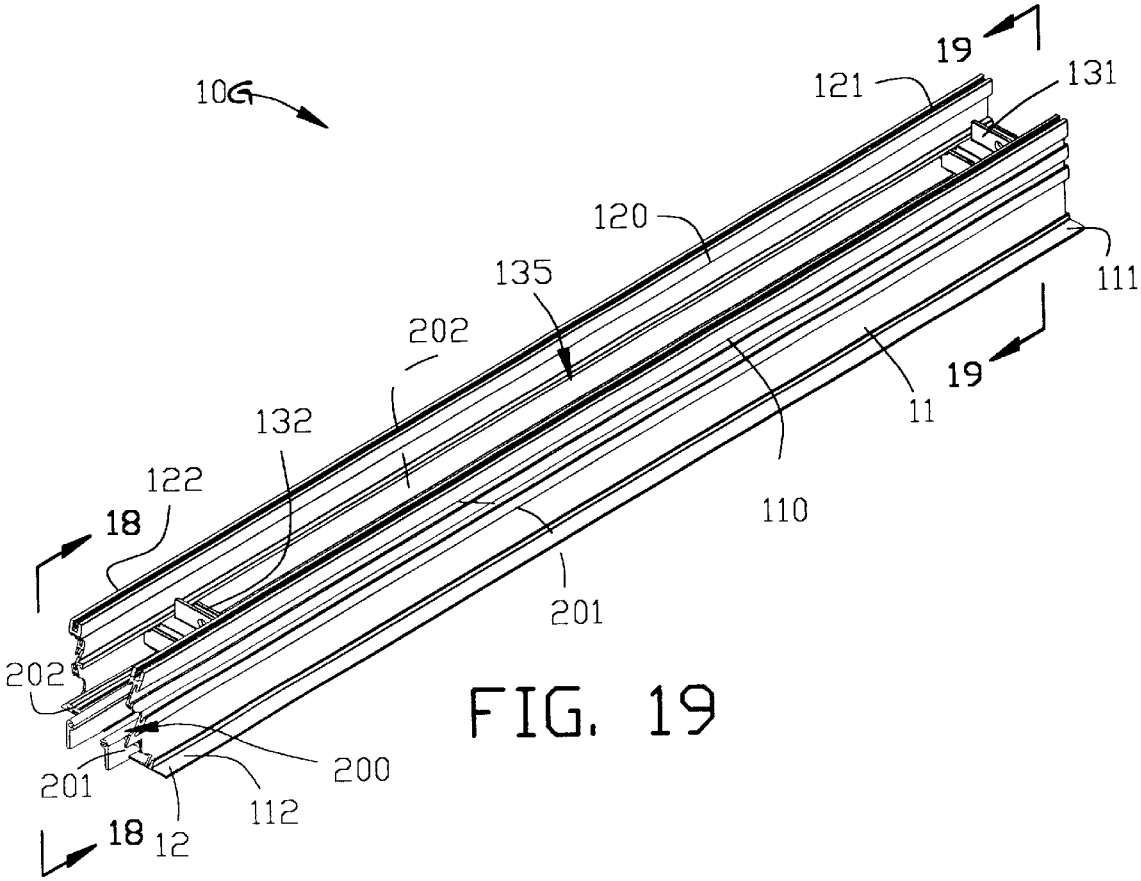
FIG. 19 is a top isometric view of a second embodiment of the improved air diffuser of FIGS. 1 and 2.

FIG. 19 is an isometric view of a second embodiment of the improved air diffuser 10G of FIGS. 1 and 2. The improved air diffuser 10G includes the improved air diffuser 11 and a portion of the improved air diffuser 12 with the air diffuser 11 being identical to the air diffuser 12. The improved air diffuser 10G is similar to the improved air diffuser 10 shown in FIGS. 3–12 with similar parts labeled with similar reference numerals. The improved air diffuser 10 comprises first and second border member 110 and 120 interconnected by plural spreaders 131 and 132 thereby defining an airflow aperture 135 therebetween.

FIGS. 20–24 are various views of the second embodiment of the improved air diffuser 10G shown in FIG. 19. Each of the plural spreaders 131 and 132 comprises a first spreader element 140 and a second spreader element 160. The first and second spreader elements 140 are provided with cross-slots 151, 152, 171 and 172 and 152 for cooperating with the first and second grooves 117, 118, 127 and 128.

Each of the plural spreaders 131 and 132 comprises plural spreader springs 181 and 182 as heretofore described. The spreader springs 181 and 182 coact between the first and second spreader elements 140 and 160 for interconnecting the first and second border members 110 and 120.

The pattern controller 200 is movably disposed between the first and second spreader elements 140 and 160 for controlling the volume and the direction of airflow through the airflow aperture 135. The pattern controller 200 comprises a first and a second pattern controller 201 and 202.

The first pattern controller 201 comprises a first linear component 210 and a first angular component 220. The first linear component 210 is slidably mounted between the first and second spreader elements 140 and 160 for controlling the volume and direction of airflow through the airflow aperture 135. The first angular component 220 is pivotably mounted for controlling the volume and the direction of airflow through the airflow aperture 135.

The second pattern controller 202 comprises a second linear component 230 and a second angular component 240. The second linear component 230 is slidably mounted between the first and second spreader elements 140 and 160 for controlling the volume and direction of airflow through the airflow aperture 135. The second angular component 240 is pivotably mounted for controlling the volume and the direction of airflow through the airflow aperture 135.

The first linear component 210 is formed from a plurality of interconnected cylindrical elements 214. Similarly, the second linear component 230 is formed from a plurality of interconnected cylindrical elements 234.

The first angular component 220 comprise a planar portion 224 and a tubular portion 226. The second angular component 240 comprise planar portion 244 and tubular portion 246. The first and second pivot pins 227 and 229 extend from the tubular portion 226 of the first angular component 220. Similarly, the first and second pivot pins 247 and 249 extend from the tubular portion 246 of the second angular component 240.

Figure 24:
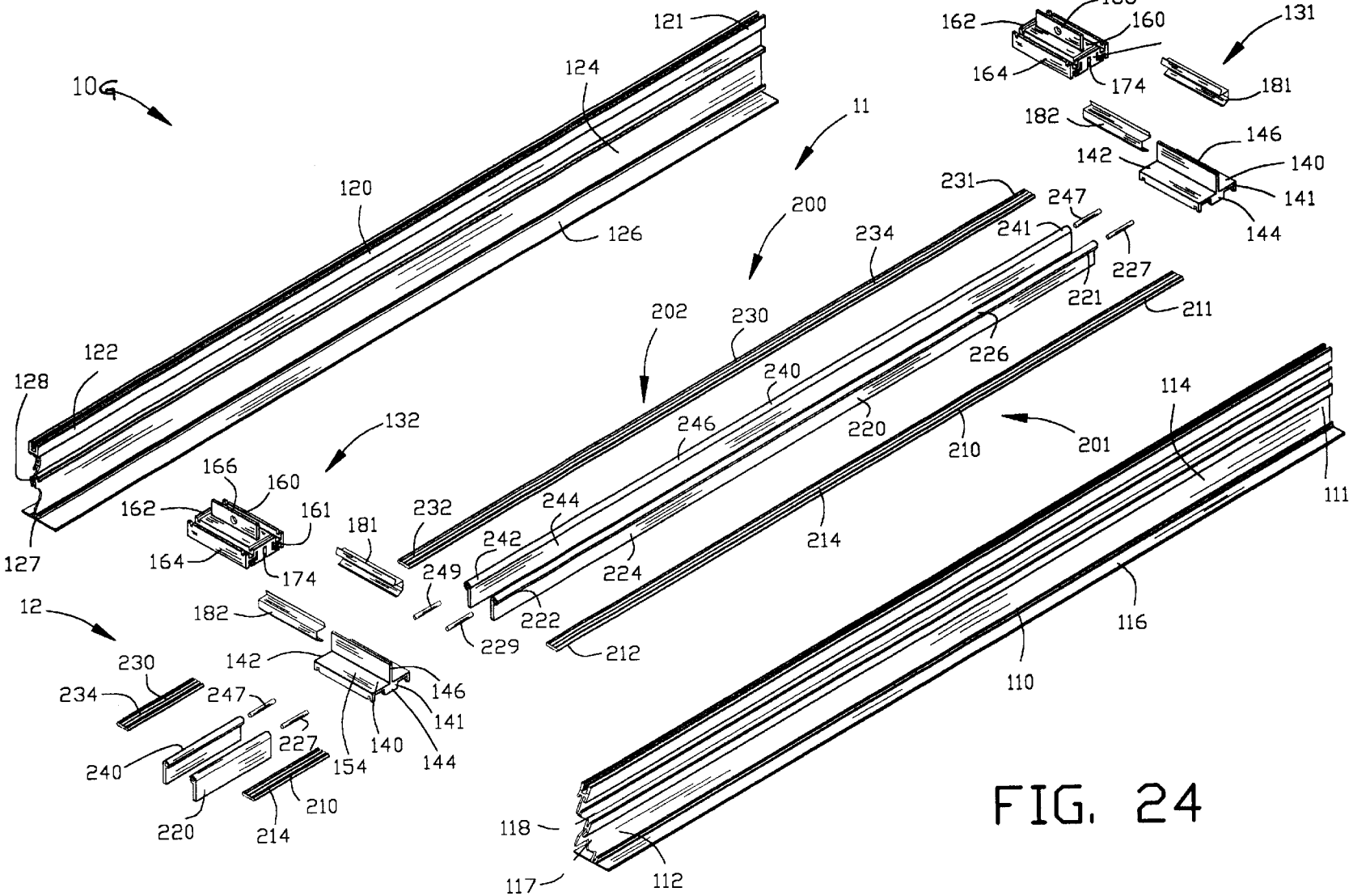
FIG. 24 is an exploded isometric view of the improved air diffuser of FIG. 19.
Figure 25:
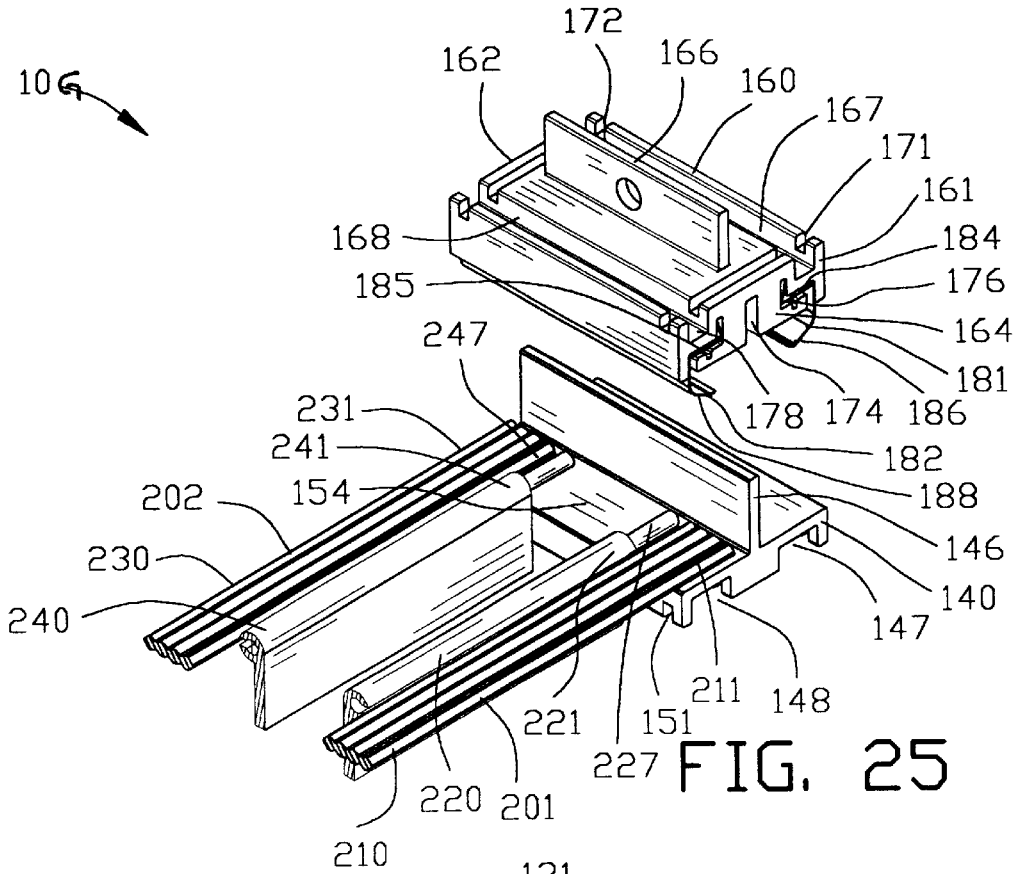
FIG. 25 is an enlarged partially assembled view of a portion of FIGS. 24.
Figure 26:
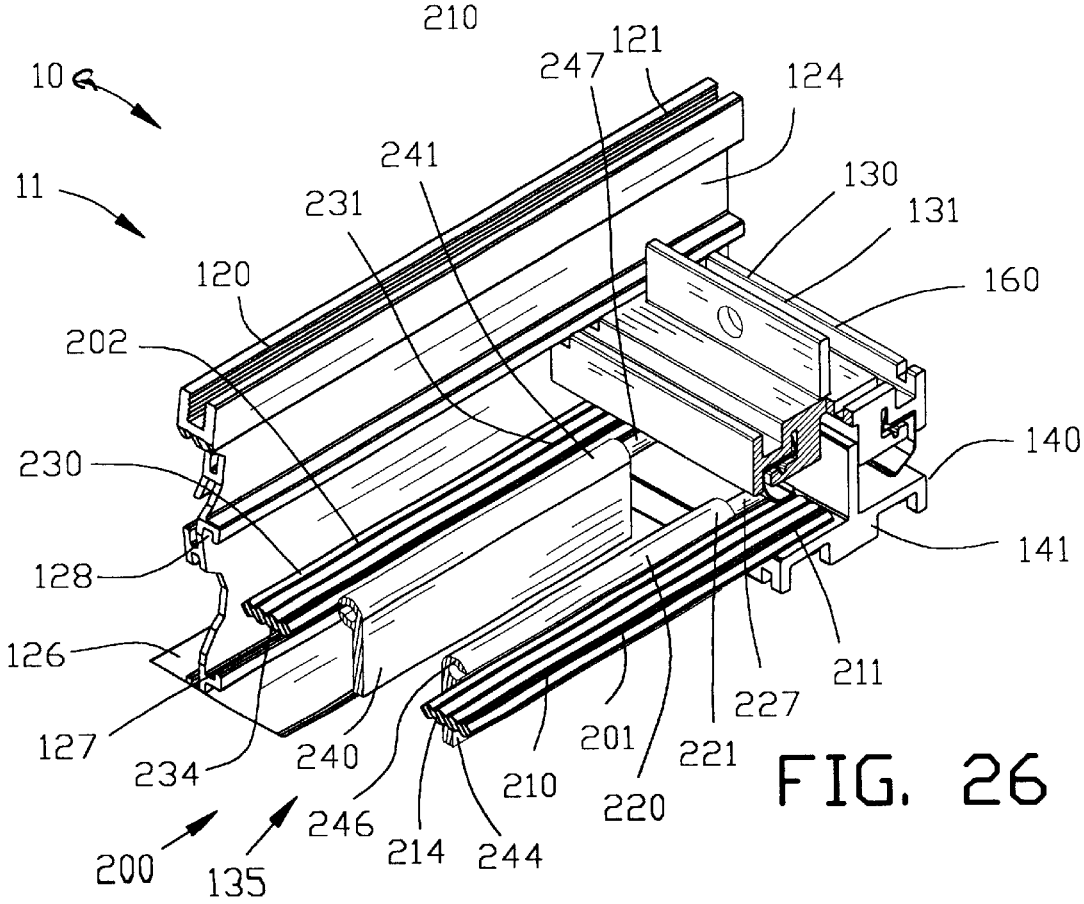
FIG. 26 is a more fully assembled view of FIGS. 25.

FIGS. 25 and 26 are enlarged views of a portion of FIG. 24 in sequentially increasing levels of assembly. In this second embodiment of the invention, the first and second linear components 210 and 230 are slidably disposed between the first and second spreader elements 140 and 160. The first and second linear components 210 and 230 are slidable independently between the spreader springs 181 and 182 and the sliding surfaces 154 of the first spreader element 140. The first and second linear components 210 and 230 are slidable independently within the airflow aperture 135.

In contrast to the first embodiment of the invention shown in FIGS. 3–17, the first and second linear component 210 and 230 are slidable directly between the spreader springs 181 and 182 and the sliding surfaces 154 of the first spreader element 140. The second embodiment of the invention eliminates the use of the control clips 251, 252, 271 and 272.

The plurality of interconnected cylindrical elements 214 and 234 of the first and second linear components 210 and 230 reduce the friction between the first and second linear components 210 and 230 and the spreader springs 181 and 182 and the sliding surfaces 154 of the first spreader element 140.

In this second embodiment of the invention, the first and second angular components 220 and 240 are disposed between the first and second spreader elements 140 and 160. The first and second angular components 220 and 240 are slidable and pivotable between the spreader springs 181 and 182 and the sliding surfaces 154 of the first spreader element 140.

In contrast to the first embodiment of the invention shown in FIGS. 3–17, the first and second angular components 220 and 240 are slidable and pivotable directly between the spreader springs 181 and 182 and the sliding surfaces 154 of the first spreader clement 140. The second embodiment of the invention eliminates the use of the control clips 251, 252, 271 and 272.

Figure 27:
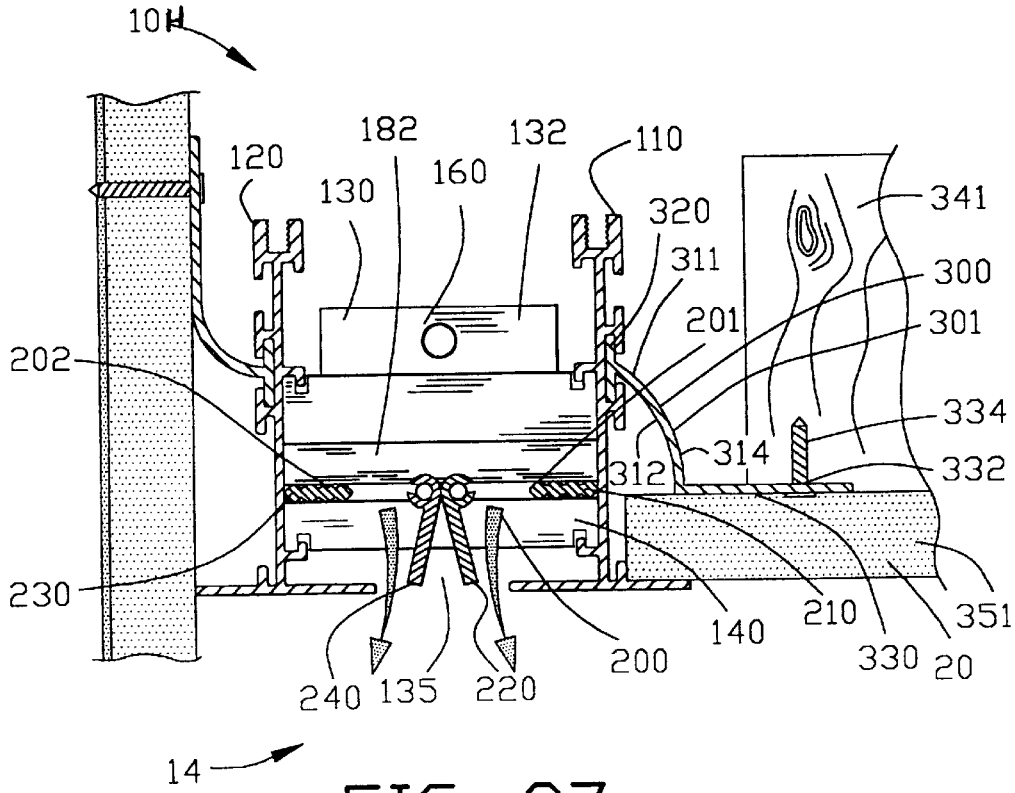
FIG. 27 is an end view similar to FIG. 20 illustrating the improved air diffuser installed in a ceiling and a side wall juncture.

FIG. 27 illustrates the improved air diffuser 10H with the first and second pattern controllers 201 and 202 being shown in the vertical right and vertical left position. More specifically, the first linear component 210 has been move to the right in FIG. 27 until the first linear component 210 contacts the first border member 110. Similarly, the second linear component 230 has been moved to the left in FIG. 27 until the second linear component 230 contacts the second border member 120.

The first angular component 220 has been rotated into a right of perpendicular position relative to the first linear component 210. Similarly, the second angular component 220 has been rotated into a left of perpendicular position relative to the second linear component 230. The first and second angular components 220 and 240 have slid to the center into contact with one another. In this arrange the improved air diffuser 10H direct flow in the vertical right and a vertical left direction.

Figure 20:
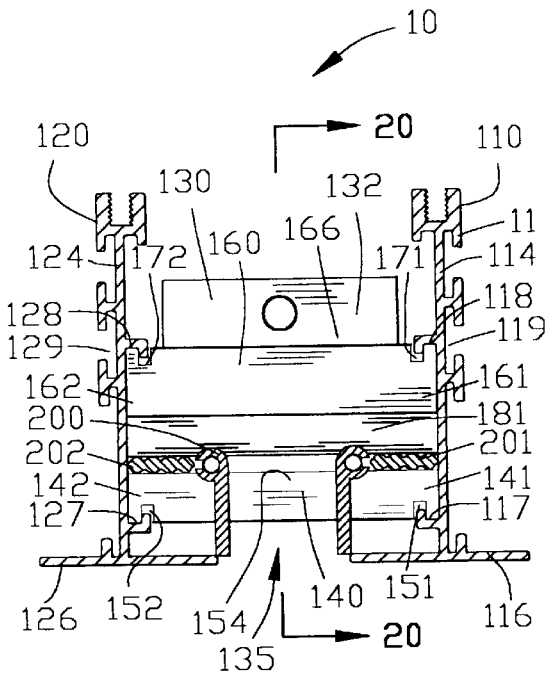
FIG. 20 is an end view along line 20—20 in FIG. 19.
Figure 21:
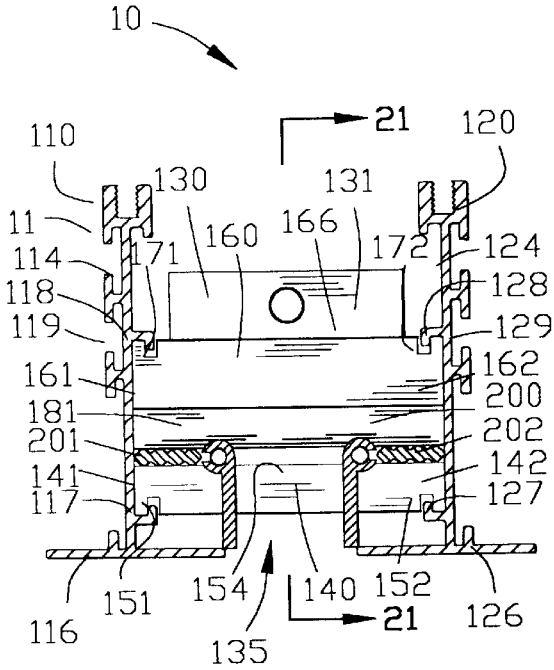
FIG. 21 is an end view along line 21—21 in FIG. 19.
Figure 23:
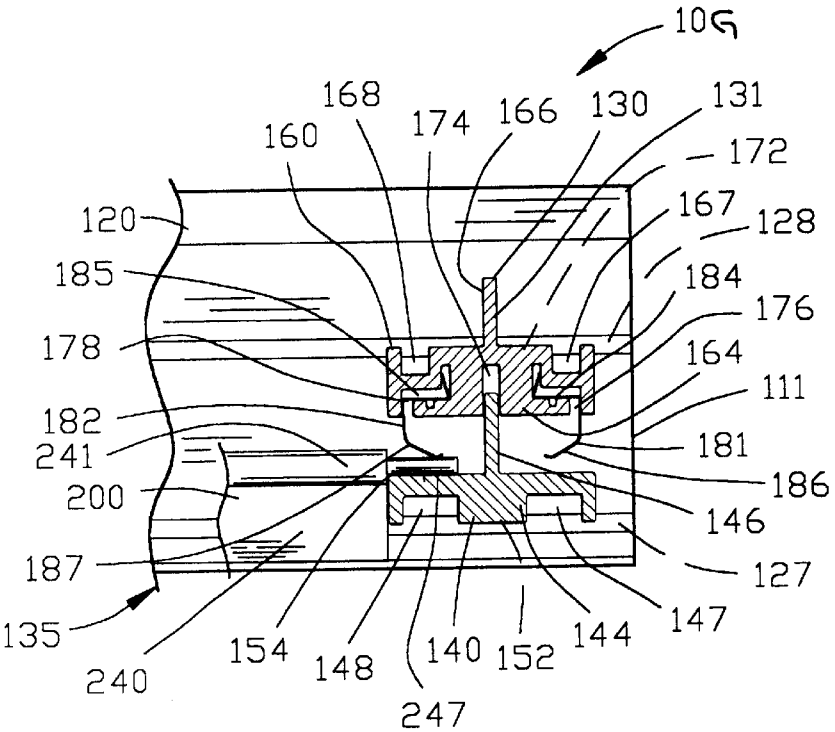
FIG. 23 is a sectional view along line 23—23 in FIG. 21.
Figure 22:
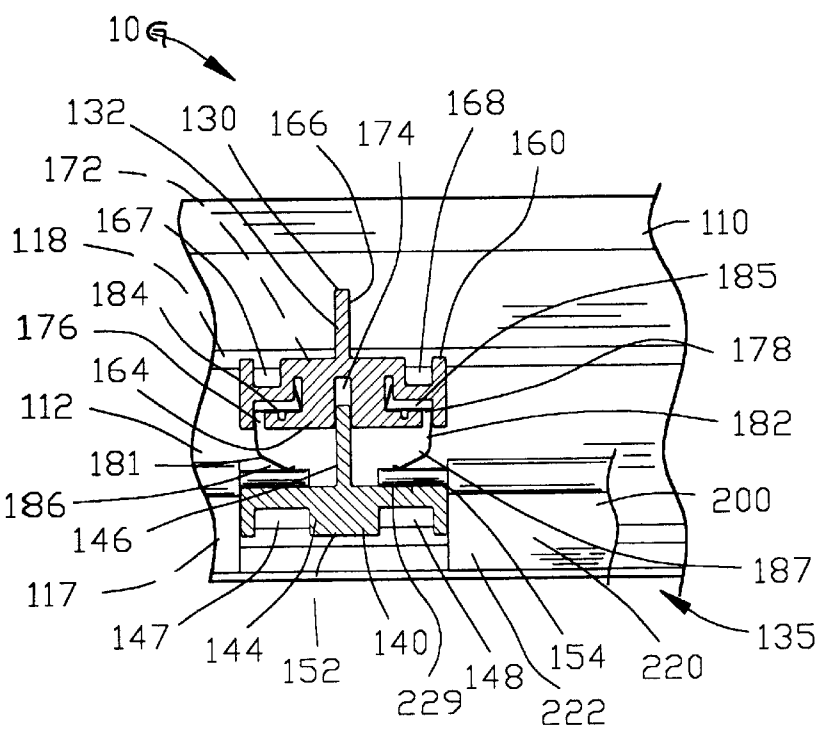
FIG. 22 is a sectional view along line 22—22 in FIG. 20.
Figure 28:
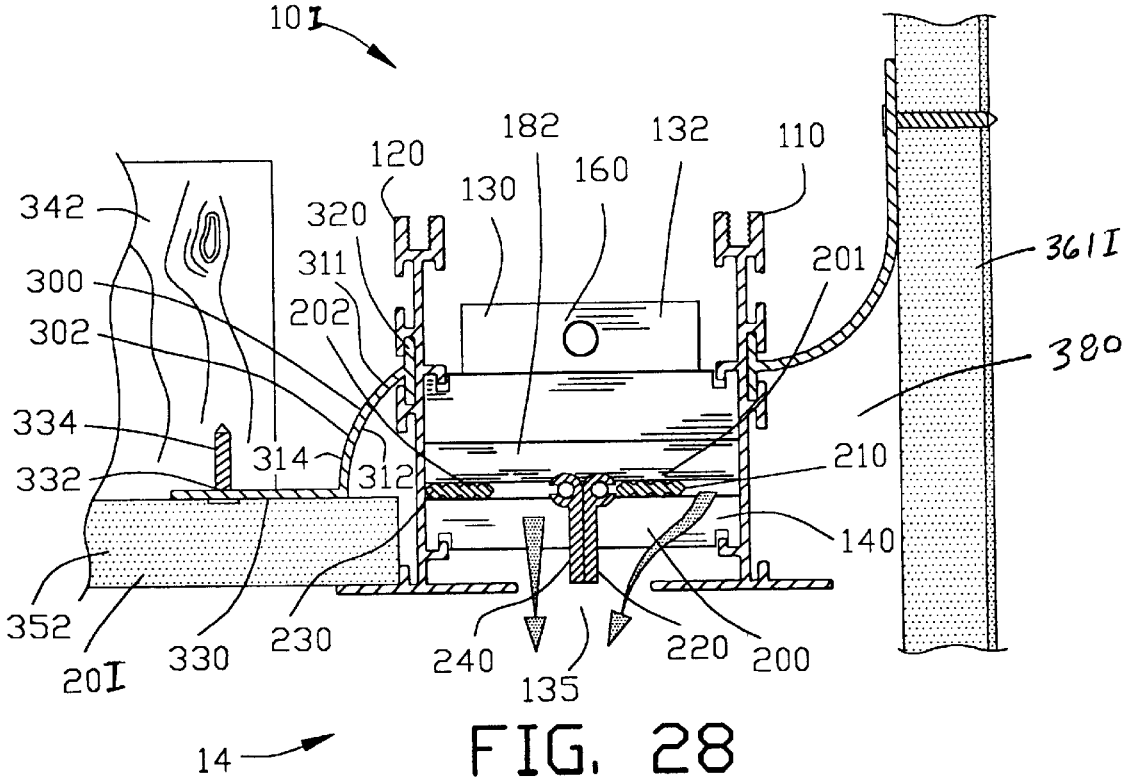
FIG. 28 is an end view similar to FIG. 20 illustrating the improved air diffuser installed in a ceiling and a side wall juncture and defining an air return.

FIG. 28 is an end view similar to FIG. 20 illustrating the improved air diffuser 10I installed in a ceiling 20H in proximity to a side wall 361I. The improved air diffuser 10I has been mounted with the first border member 110 displaced from the side wall 361I for defining an air return 380.

FIG. 28 illustrates the improved air diffuser 10I with the first and second pattern controllers 201 and 202 being shown in the vertical and the vertical left position. More specifically, the first linear component 210 has been move to the center in FIG. 28 until the first linear component 210 contacts the first angular component 220. The second linear component 230 has been moved to the left in FIG. 27 until the second linear component 230 contacts the second border member 120.

The first angular component 220 has been rotated into a perpendicular position relative to the first linear component 210. Similarly, the second angular component 220 has been rotated into a perpendicular position relative to the second linear component 230. The second angular component 240 have slid to the center into contact with one another. In this arrangement, the improved air diffuser 10H directs airflow in the vertical and a vertical left direction.

Figure 29:
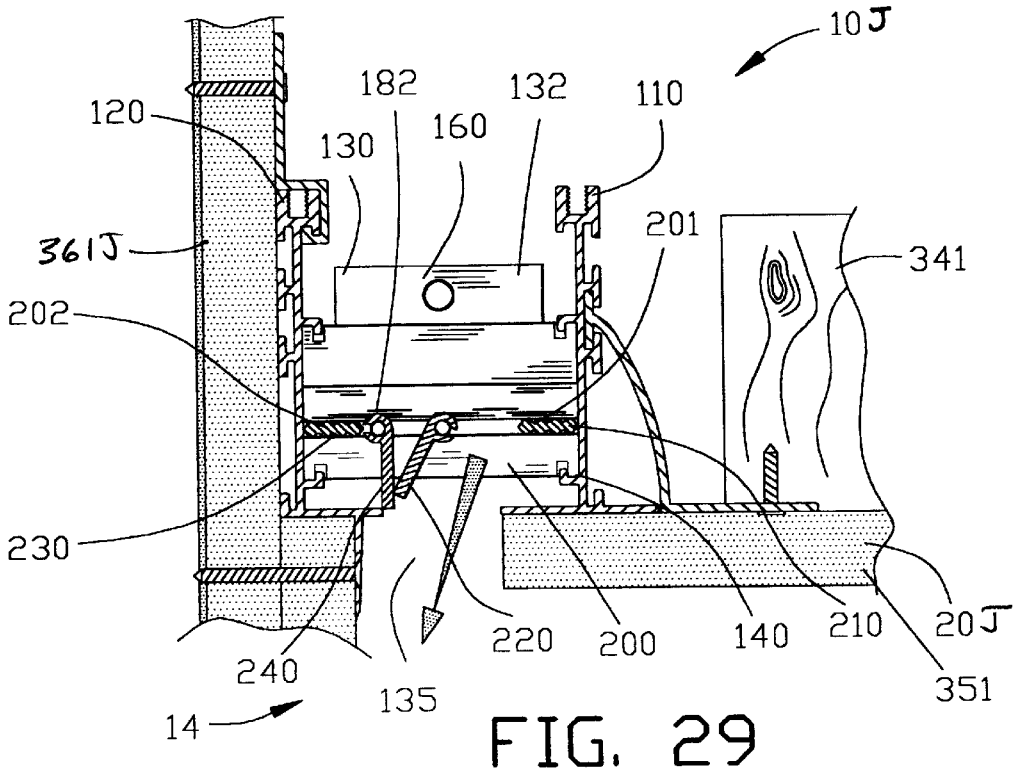
FIG. 29 is an end view similar to FIG. 20 illustrating the improved air diffuser installed in a ceiling and a side wall juncture.

FIG. 29 is an end view similar to FIG. 20 illustrating the improved air diffuser 10J installed in a ceiling 20J in proximity to a side wall 361J. The improved air diffuser 10J with the first and second pattern controllers 201 and 202 being shown in a vertical left position. More specifically, the first linear component 210 has been move to the right in FIG. 29 until the first linear component 210 contacts the first border member 110. The second linear component 230 has been moved to the left in FIG. 29 until the second linear component 230 contacts the second border member 120.

The first angular component 220 has been rotated into a left of perpendicular position relative to the first linear component 210. Similarly, the second angular component 220 has been rotated into a perpendicular position relative to the second linear component 230. The second angular component 240 has been slid into contact with the second linear component 230. The first angular component 220 has been position relative to the second linear component 230. The second angular component 240 has been slid into contact with the second linear component 230. In this arrangement, the improved air diffuser 10J directs airflow in the vertical left direction.

Figure 30:
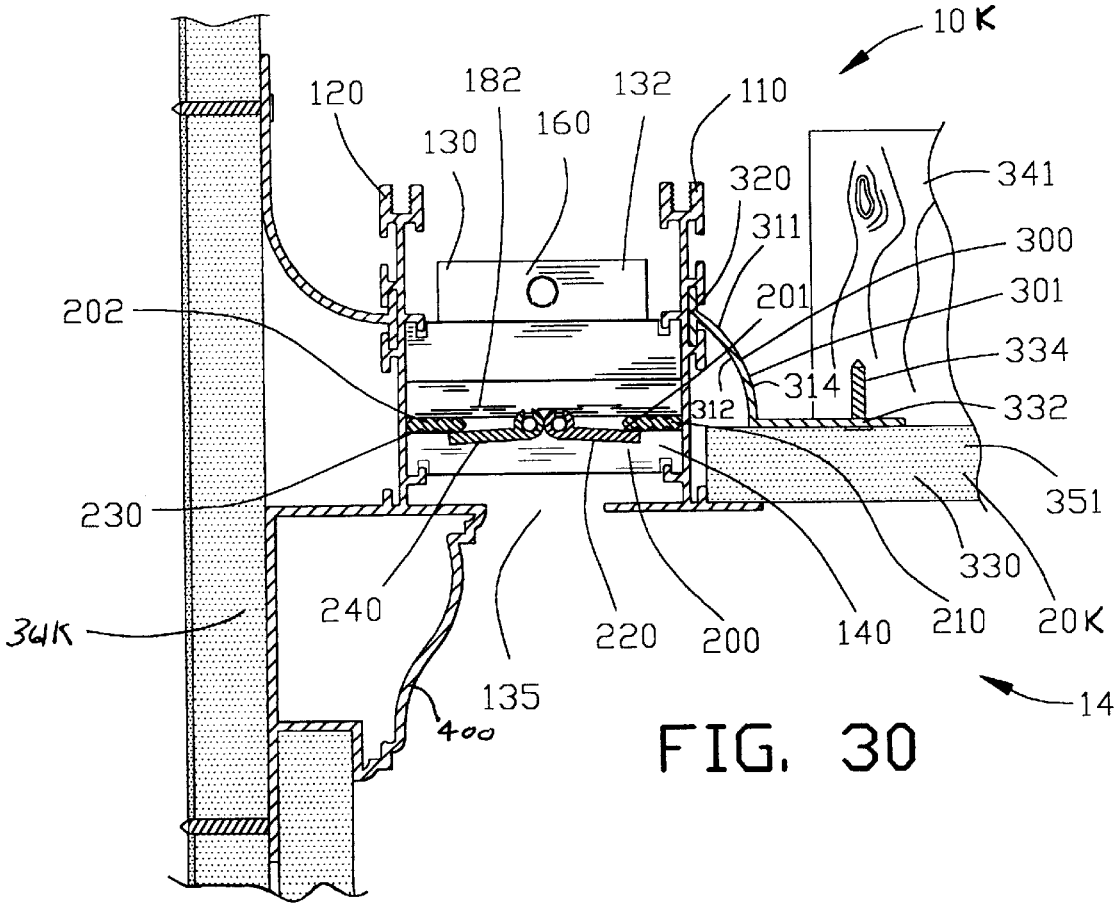
FIG. 30 is an end view similar to FIG. 20 illustrating the improved air diffuser incorporating an integral decorative molding installed in a ceiling and a side wall juncture.

FIG. 30 is an end view similar to FIG. 20 illustrating the improved air diffuser 10K with an integral decorative molding 400 installed in a juncture of the ceiling 20K and a side wall 361K. In this embodiment of the invention, the second border 120 having a decorative portion 400 for simulating a molding when the second border 120 is disposed adjacent to a junction of the horizontal surface shown as a ceiling 20K with a vertical surface shown as a side wall 361 K. The second border 120 is secured to the horizontal surface 20K and the decorative portion is secured to the vertical surface 361K.

The decorative portion 400 has a generally triangular cross-section for simulating a molding when said second border 120 is disposed adjacent to the juncture of the ceiling 20K and a side wall 361K. Preferably, the decorative portion 400 has a hollow center. The decorative portion 400 may be formed as a unitary member with the second first border 120 as a one piece extruded assembly.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An air diffuser for an air distribution system for mounting in proximity to an intersection of a ceiling surface and a wall surface, comprising:

a first border member having a first border member surface;

a second border member having a second border member surface plural spreaders interconnecting said first and second border members thereby defining an airflow aperture therebetween, a first mounting for mounting said first border member to the ceiling surface with said first border member surface of said first border being generally parallel to the ceiling surface;

a second mounting for mounting said second border member to the wall surface with said second border member surface of said second border being generally parallel to the ceiling surface; and a decorative portion depending from said second border member and engaging the wall surface for simulating a molding located at a junction of the ceiling surface with the wall surface.

2. An air diffuser for an air distribution system as set forth in claim 1, wherein said decorative portion is unitary with said second border as a one piece extruded assembly.

3. An air diffuser for an air distribution system as set forth in claim 1, wherein said decorative portion has a cross-section for simulating a molding located at a junction of the ceiling surface with the wall surface.

4. An air diffuser for an air distribution system as set forth in claim 1, wherein said decorative portion has a generally triangular cross-section for simulating a molding located at a junction of the ceiling surface with the wall surface.

5. An air diffuser for an air distribution system for mounting in proximity to an intersection of a ceiling surface and a wall surface, comprising:

a first border member having a first border member surface;

a second border member having a second border member surface plural spreaders interconnecting said first and second border members thereby defining an airflow aperture therebetween, a pattern controller movably disposed between said plural spreaders for controlling the volume of airflow through said airflow aperture;

a first mounting for mounting said first border member to the ceiling surface with said first border member surface of said first border being generally parallel to the ceiling surface;

a second mounting for mounting said second border member to the wall surface with said second border member surface of said second border being generally parallel to the ceiling surface;

a decorative portion unitary with said second border and depending from said second border member;

said decorative portion having a cross-section and engaging the wall surface for simulating a molding located at a junction of the ceiling surface with the wall surface.

6. An air diffuser for an air distribution system for mounting in proximity to an intersection of a ceiling surface and a wall surface, comprising:

a first border member having a first border member surface;

a second border member having a second border member surface;

plural spreaders interconnecting said first and second border members thereby defining an airflow aperture therebetween;

a first mounting for mounting said first border member relative to the ceiling surface with said first border member surface of said first border being generally aligned relative to the ceiling surface;

a second mounting for mounting said second border member relative to the wall surface with said second border member surface of said second border being generally aligned relative to the ceiling surface; and a decorative portion depending from said second border member below said ceiling surface and engaging the wall surface for simulating a molding located at a junction of the ceiling surface with the wall surface.

7. An air diffuser for an air distribution system as set forth in claim 6, wherein said decorative portions has a generally triangular cross-section for simulating a molding located at a junction of the ceiling surface with the wall surface.

8. An air diffuser for an air distribution system for mounting in proximity to an intersection of a ceiling surface and a wall surface, comprising:

a first border member having a first border member surface;

a second border member having a second border member surface;

plural spreaders interconnecting said first and second border members thereby defining an airflow aperture therebetween;

a pattern controller movably disposed between said plural spreaders for controlling the volume of airflow through said airflow aperture;

a first mounting for mounting said first border member relative to the ceiling surface;

a second mounting for mounting said second border member relative to the wall surface;

a decorative portion unitary with and depending from said second border member below said ceiling surface; and said decorative portion having a cross-section for simulating a molding located at a junction of the ceiling surface with the wall surface.

* * * * *